United States Patent [19]

O'Keefe et al.

[11] 4,375,638

[45] Mar. 1, 1983

[54] SCROLLING DISPLAY REFRESH MEMORY ADDRESS GENERATION APPARATUS

[75] Inventors: David B. O'Keefe, Westford; Robert C. Miller, Braintree, both of Mass.

[73] Assignee: Honeywell Information Systems Inc., Waltham, Mass.

[21] Appl. No.: 159,719

[22] Filed: Jun. 16, 1980

[51] Int. Cl.[3] ..... G09G 1/16

[52] U.S. Cl. ..... 340/726; 340/750; 340/801

[58] Field of Search ..... 340/726, 724, 723, 711, 340/750, 799, 801

[56] References Cited

U.S. PATENT DOCUMENTS

| | | | |
|---|---|---|---|
| 3,242,470 | 3/1966 | Hagelbarger et al. | 340/724 |
| 3,406,387 | 10/1968 | Werme | 340/711 |
| 3,787,833 | 1/1974 | Rogers | 340/726 |

*Primary Examiner*—Marshall M. Curtis

*Attorney, Agent, or Firm*—William A. Linnell; Nicholas Prasinos

[57] ABSTRACT

A refresh memory address generation apparatus for a video display controller is disclosed wherein rows of character information stored in a display refresh memory may be relocated without requiring the reconstruction of the display information as stored in the display refresh memory. A roll register and PROMs precoded to perform modular addition and multiplication are used to generate an address used to access the display controller refresh memory such that all but one stationary row of information on the display screen may be scrolled (rolled) up. The scrolling of the information on the display screen is accomplished without requiring movement of the display information in the refresh memory, and the only rewrite of information in the refresh memory is done to blank the one row of information which is vacated.

9 Claims, 17 Drawing Figures

REFRESH ADDRESS GENERATION LOGIC

DISPLAY CONTROLLER AND DISPLAY MONITOR LOGIC

SHEET 1 OF 2

DISPLAY CONTROLLER AND DISPLAY MONITOR LOGIC

SHEET 2 OF 2

TRANSMIT LOGIC AND RECEIVE LOGIC

REFRESH MEMORY DATA FORMAT

CHARACTER CELL SCAN DOTS

| LOCATION ADDRESS (HEX) | 2' | 3' | 4' | 5' | 6' | 7' | 8' | SCAN LINE 12 INDICATOR | CHARACTER CELL SCAN LINES |
|---|---|---|---|---|---|---|---|---|---|
| PROM BITS | 1 | 2 | 3 | 4 | 5 | 6 | 7 | 8 | |
| 40F | | | | | | | | | |
| 410 | | | | | | | | | 1 |
| 411 | | | 0 | 0 | 0 | | | | 2 |
| 412 | | 0 | 0 | | 0 | 0 | | | 3 |
| 413 | 0 | 0 | | | | 0 | 0 | | 4 |
| 414 | 0 | 0 | | | | 0 | 0 | | 5 |
| 415 | 0 | 0 | | | | 0 | 0 | | 6 |
| 416 | 0 | 0 | 0 | 0 | 0 | 0 | 0 | | 7 |
| 417 | 0 | 0 | | | | 0 | 0 | | 8 |
| 418 | 0 | 0 | | | | 0 | 0 | | 9 |
| 419 | 0 | 0 | | | | 0 | 0 | | 10 |
| 41A | | | | | | | | | 11 |
| 41B | | | | | | | | 0 | 12 |
| 41C | | | | | | | | | 13 |
| 41D | | | | | | | | | |
| 41E | | | | | | | | | |
| 41F | | | | | | | | | |
| 420 | | | | | | | | | |
| 421 | 0 | 0 | 0 | 0 | 0 | | | | |
| 422 | 0 | 0 | | | 0 | 0 | | | |

| CHAR | ASCII CODE (HEX) |
|---|---|
| @ | 40 |
| A | 41 |
| B | 42 |

DOT PATTERN GENERATOR PROM DATA FORMAT

Fig. 9

VIDEO ATTRIBUTE GENERATOR PROM DATA FORMAT

| BLKTM2 (DATA BLINK CONTROL) | BLKTM1 (CURSOR BLINK CONTROL) | DISPLAY SCREEN CHARACTER CELL |
|---|---|---|
| 0 | 0 | □ |
| 0 | 1 | _ |
| 1 | 0 | A |
| 1 | 1 | A |

EXAMPLE: CURSOR LOCATED IN A BLINKING CHARACTER CELL

| REFRESH MEMORY LOCATION ADDRESS | | DISPLAY ROW IF ROLL EQUAL 0 |
|---|---|---|
| 0 | DISPLAY ROW =((ROLL REG) MODULO 24)+1 | 1 |
| 80 | DISPLAY ROW =((ROLL REG+1) MODULO 24)+1 | 2 |
| 160 | DISPLAY ROW = ((ROLL REG+2) MODULO 24)+1 | 3 |
| 240 | | 4 |
| 320 | | 5 |
| 400 | • | 6 |
| 480 | • | 7 |
| 560 | • | 8 |
| 640 | ETC. | 9 |
| 720 | • | 10 |
| 800 | • | 11 |
| 880 | • | 12 |
| 960 | | 13 |
| 1040 | | 14 |
| 1120 | | 15 |
| 1200 | | 16 |
| 1280 | | 17 |
| 1360 | | 18 |
| 1440 | | 19 |
| 1520 | | 20 |
| 1600 | | 21 |
| 1680 | | 22 |
| 1760 | DISPLAY ROW = (( ROLL REG+22) MODULO24)+1 | 23 |
| 1840 | DISPLAY ROW = (( ROLL REG+23) MODULO24)+1 | 24 |
| 1920 | DISPLAY ROW 25 | 25 |
| 2000 | 48 WORDS UNUSED | |

REFRESH MEMORY LAYOUT

Fig. 12

REFRESH ADDRESS GENERATION LOGIC

ROLLED ROW PROM DATA FORMAT

ROW ADDRESS PROM DATA FORMAT

SCROLLING DISPLAY REFRESH MEMORY ADDRESS GENERATION APPARATUS

CROSS REFERENCE TO RELATED APPLICATIONS

The following patent applications, which are assigned to the same assignee as the instant application, have related subject matter and are incorporated herein by reference. Certain portions of the system and processes herein disclosed are not our invention, but are the invention of the below-named inventors as defined by the claims in the following patent applications:

| TITLE | INVENTORS | SERIAL NUMBER |
|---|---|---|
| Remote Monitor Interface | Gordon Lewis Steiner<br>David B. O'Keefe<br>Robert C. Miller | 127,671 |
| Keyboard Strobe Generation System | Robert C. Miller<br>David B. O'Keefe | |
| Display Video Generation System | David B. O'Keefe<br>Robert C. Miller | |

BACKGROUND OF THE INVENTION

1. Field of the Invention

This invention relates to video display systems and more particularly to a display refresh memory address generation apparatus for scrolling rows of character information stored in the display system refresh memory in a manner which does not require the reconstruction of the data information as originally stored in the refresh memory.

2. Description of the Prior Art

Information is normally displayed on the cathode ray tube of a display monitor by selectively energizing an electron beam as it scans the sensitized screen of the CRT. The electron beam normally scans the screen from left to right in a succession of horizontal scan paths which begin at the top of the screen and end at the bottom of the screen. The beam is subsequently returned to the top of the screen for the next successive raster scan of the entire screen. This is accomplished by monitor electronics, or beam drive circuitry, associated with the cathode ray tube which magnetically deflects the beam in both the horizontal and vertical directions and selectively energizes the beam as it scans the screen of the CRT. The horizontal retrace of the beam is initiated by a horizontal synchronization (SYNC) signal, the vertical return of the beam to the top of the screen is initiated by a vertical sync signal and the beam is selectively energized in response to a video signal. These signals, the horizontal sync, vertical sync, and video signals are generated by the display controller and transferred to the monitor electronics which in turn uses them to generate the signals which drive the electron beam gun and beam deflection magnets.

In addition to generating the video and sync signals, some displays allow the information to be displayed in a variety of intensities on the CRT screen, for example, a display may allow information to be displayed in normal brightness or in a low intensity mode which is less than the normal brightness. In this case, a low intensity signal must also be generated by the display controller to control the intensity of the information on the display screen. In addition to an intensity mode which may be associated with an individual character or a field of characters which is to be displayed on the display screen, other visual attributes are often found in display systems. For example, an inverse video attribute can indicate that the character of information is to be displayed as a dark character on a light background as opposed to the normal case of a light character on a dark background. A blink video attribute allows the character of information to be blinked on the display screen to draw the display operator's attention to the information. An underline visual attribute allows the character of information in the row to be displayed with an underline under the character. A hide visual attribute results in the blocking of the video signal such that sensitive data will not be displayed on the display screen, although it is available in the refresh memory and may be transmitted or received from a computer attached to the display controller or remotely over a communication line attached to the display controller. In addition, the cursor may be treated as a visual attribute to modify the character which would otherwise be displayed on the display screen to indicate to the operator where the next character of data which is entered from a keyboard attached to the display controller will be placed on the display screen.

The display controller generates the horizontal sync and the vertical sync signals by use of raster scan logic. The video signals are generated by the display controller scanning a refresh memory in the display controller which contains the information which is to be displayed on the CRT screen. The video signals are generated by the display controller scanning the refresh memory a character at a time as each row of information is displayed on the CRT screen. The information within the display controller refresh memory may originate from a keyboard attached to the display terminal, from a computer attached to the display controller, or remotely from a communications line attached to the display controller.

Display controllers have generally stored rows of character information in display refresh memories in a predetermined order. Each row of character information has been read from the refresh memory sequentially in the order stored. In order to scroll the rows of character information on the display screen, a reconstruction of the character information within the refresh memory had been required. More recently, parallel length rows of character information have been stored in the display refresh memory wherein each row contains a trailing firmware code which upon detection by the display controller is used to address the next row of character information which may be randomly located within the refresh memory. Rows of character information may be added, deleted, or re-ordered in any manner without requiring the reconstruction of the character information as stored in the refresh memory. Such a system is described in the U.S. patent application Ser. No. 034,832 entitled "Hardware/Firmware CRT Display Link System" by Joseph L. Ryan and Gerald N. Winfrey, filed on Apr. 30, 1979.

In the present invention, rows of character information are stored in fixed length rows in the display controller refresh memory. The display controller includes a roll register which is loaded with the value corresponding to the number of rows that the information on the display screen is to be rolled (scrolled) and this value is used in generating a relocated address which is used to retrieve the character information stored in the refresh memory. Thus, rows of character information may be scrolled up or down on the display screen without requiring the reconstruction of the character information in the refresh memory other than to blank out the character information in each vacated row.

OBJECT OF THE INVENTION

Accordingly, it is an object of the present invention to provide a low-cost system for scrolling rows of information on a display screen without requiring the movement or rewriting of large amounts of information in the refresh memory of the display controller.

It is a further object of the present invention to provide refresh address generation logic which will allow some rows of information on a display screen to be scrolled while allowing for one or more other rows of information to remain in a fixed position on the display screen and in the refresh memory.

It is a still further object of the present invention to provide a refresh address generation logic apparatus having a low manufacturing cost.

This invention is pointed out with particularity in the appended claims. An understanding of the above and further objects and advantage of this invention can be obtained by referring to the following description taken in conjunction with the drawings.

BRIEF DESCRIPTION OF THE DRAWINGS

The manner in which the apparatus of the present invention is constructed and its mode of operation can best be understood in light of the following detailed description taken together with the accompanying drawings in which like reference numerals identify like elements in the several figures and in which:

FIG. 9 is a diagram illustrating the data format and a portion of the data contained in the dot pattern generator of FIGS. 4 and 7;

FIG. 12 is a diagram illustrating the layout of the refresh memory showing the correspondence between rows of information to be displayed on the display screen and the location address in which they are stored in the refresh memory;

SUMMARY OF THE INVENTION

A video display refresh memory address generation apparatus for a video display controller having a refresh memory is provided wherein rows of video information of fixed lengths stored in the refresh memory may be scrolled (rolled) in a manner without requiring the reconstruction of the video information. More particularly, a roll register is provided to hold a roll value indicative of the number of rows that the video information on the display screen is to be scrolled. The roll value is added to the row value from the raster scan refresh row counter and the sum is taken modulo the number of scrollable lines on the display screen by a first means to produce a relocated row value. The relocated row value is then effectively multiplied by the number of columns per fixed length video information row and the column value from the raster scan refresh column counter is added to the product by a second means to produce a relocated cell address within the refresh memory.

In one aspect of the invention, video information rows stored in the refresh memory may be read from the refresh memory and displayed on the display screen in a scrolled up or down manner by merely changing the roll value in the roll register.

In another aspect of the invention, not all rows of video information need be scrolled on the display screen and the video information associated with the fixed (non-scrolled) rows can be maintained at fixed addresses in the refresh memory.

DETAILED DESCRIPTION OF THE PREFERRED EMBODIMENT

Figure 1:
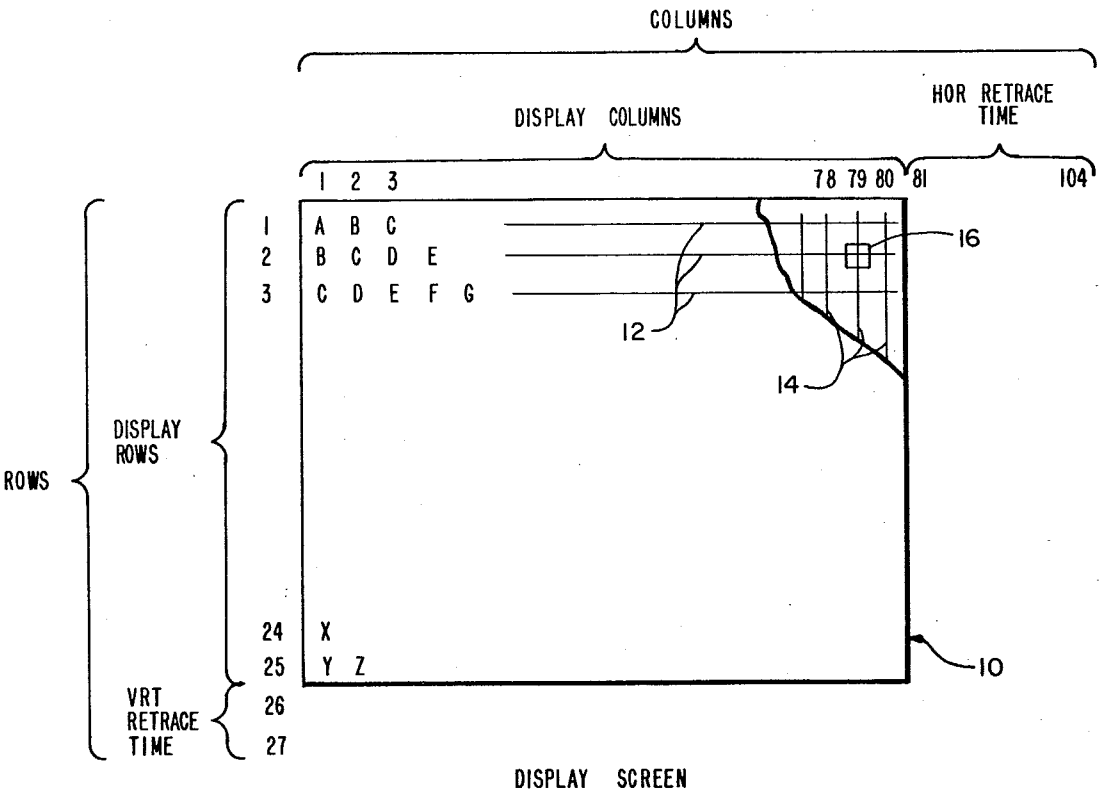
FIG. 1 is a video display of information on the display screen of a CRT.

Referring to FIG. 1, a display screen 10 is illustrated along with a particular arrangement of alphanumeric characters appearing thereon. Such a display is commonly found in computer terminals where the information is displayed on the screen for any number of purposes. It is to be noted that the alphanumeric characters appearing in FIG. 1 are arranged in a plurality of rows 12 and columns 14. In the preferred embodiment, a maximum of 80 characters are sequentially formed in columns 1 through 80 in a given row and appear on the display screen. Columns 81 through 104 as illustrated in FIG. 1 do not actually appear on the face of the display screen 10 and the time associated with them is used for the horizontal retrace of the raster scan beam between lines as described hereinafter in conjunction with FIG. 3. Also in the preferred embodiment, as illustrated in FIG. 1, there are 25 rows, rows 1 through 25, appearing on display screen 10. Rows 26 and 27 are illustrated in FIG. 1 do not appear on display screen 10 and the time associated therewith is used for the vertical retrace of the raster scan beam as will be discussed hereinafter in conjunction with FIG. 3.

Figure 2:
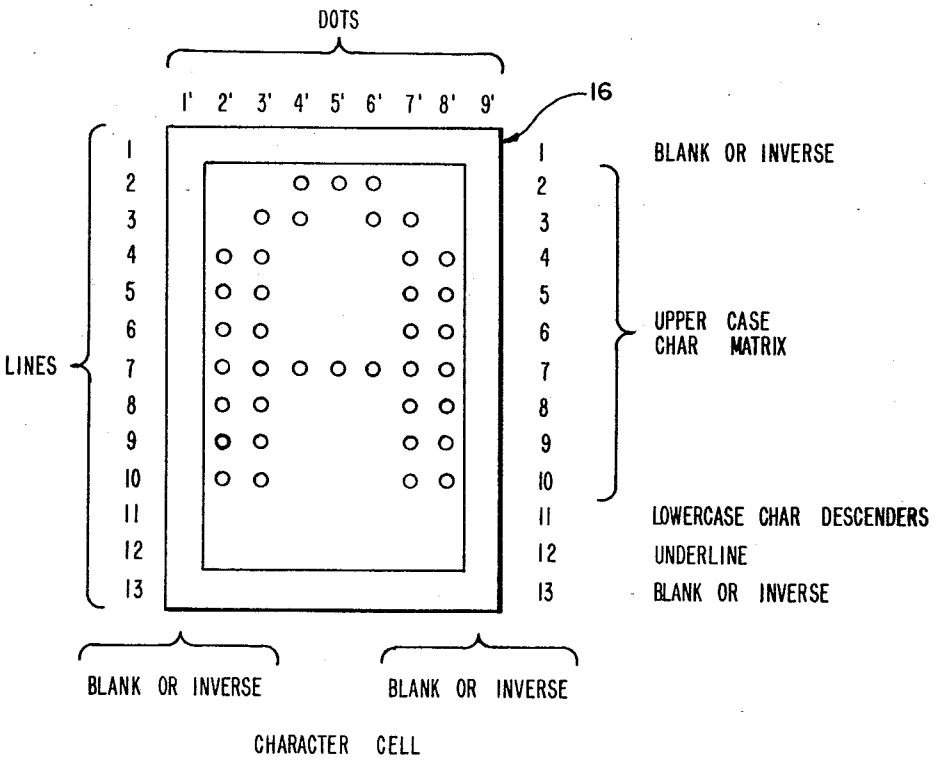
FIG. 2 illustrates the formation of a character within a character cell on the display screen of FIG. 1.

Referring now to FIG. 2, the alphanumeric character occupying the character cell 16 formed by the intersection of row 2 with column 79 on display screen 10 of FIG. 1 has been illustrated in detail. The particular alphanumeric character which is illustrated is that of the letter "A". The character cell is formed by a 9 by 13 dot matrix field. Each dot in the matrix, although illustrated in FIG. 2 as a circular spot, is actually a rectangular spot with no break between consequentive illuminated spots in the same line. Characters are formed in a character cell 16 along with other characters on the same row by sequentially illuminating appropriate dots on a number of horizontal scan lines. These horizontal scan lines are numbered 1 through 13 in FIG. 2. Dots are illuminated within these lines at dot locations denoted as 1' through 9'. In the preferred embodiment, uppercase characters are displayed in a 7 by 9 field formed by dots 2' through 8' of rows 2 through 10. Dots 2' through 8' of row 11 are used for lowercase character descenders. Line 12, dots 1' through 9' are used to underline a character. The other border of dots formed dots by 1' and 9' of lines 1 through 13 and dots 2' through 8' of lines 1 and 13 are blank when the normal image on the screen is a dark background with a character displayed with bright or lighted dots. In the normal image mode, when bright characters are displayed against a dark background, dot locations 2' through 8' are selectively illuminated so as to define a given line of each character as it is formed within a given row. When characters are displayed on the screen in the inverse video mode, the background of the character is light and the character is displayed as a series of dark dots in which case the outer border of dots of the character cell is a series of bright or lighted dots. In the inverse video mode, dot locations 1' through 9' are selectively illuminated so as to define a given line of the background of a character as it is formed within a given row.

Figure 3:
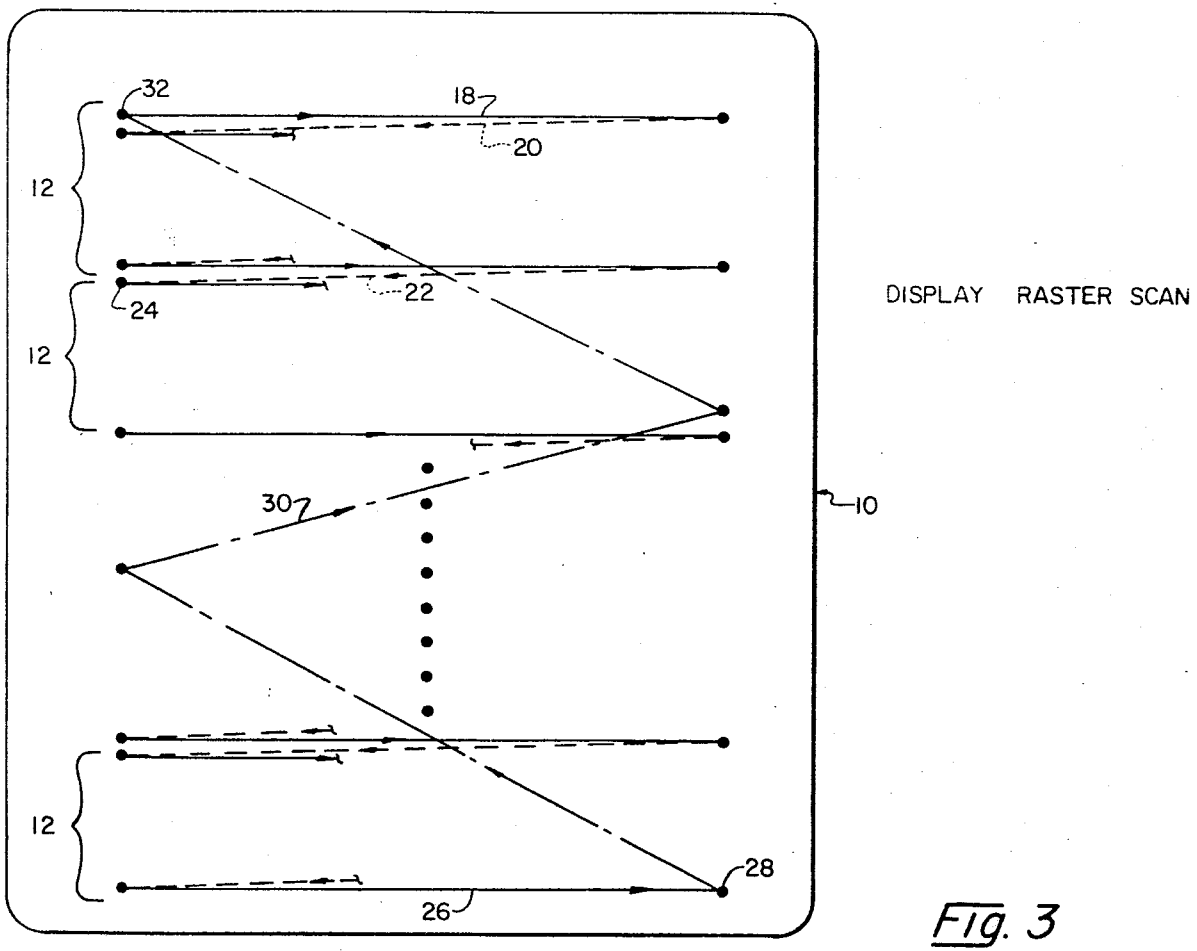
FIG. 3 illustrates the raster scan necessary to accomplish the video display of FIG. 1.

Referring now to FIG. 3, a typical raster scan is illustrated for the entire display screen 10. It is to be understood that such a raster scan would be necessary in order to form the displayed arrangement of characters in FIG. 1. In this regard, the raster scan comprises a number of individual rows such as rows 12. Each individual row comprises 13 individual horizontal scan lines such as 18. Each individual scan line is accompanied with a horizontal retrace path such as 20 which brings the electron beam back to a position for the next horizontal scan from left to right. This retrace between scan lines occurs during column times 81 through 104 as shown in FIG. 1. The next successive row of characters begins once a horizontal retrace path has been completed for the thirteenth scan line of the previous row of characters. In this regard, a retrace path 22 brings the electron beam back to a point 24 for the subsequent scan line of the next successive row. This process continues to occur until twenty-five separate rows have been formed on the display screen 10. At this time, the electron beam will have traversed a final horizontal scan line 26 in the bottommost row. When the electron beam reaches a point 28 at the end of the scan line 26, it is caused to retrace a dotted outline path 30 back to a point 32 wherein the next succession of horizontal scans begin. The dotted outline path 30 will hereinafter be referred to as the vertical retrace. During this vertical retrace which occurs during row times 26 and 27 as shown in FIG. 1, the scan path forms a zig-zag course as it travels from left to right and from right to left twenty-six times for the scan lines and horizontal retrace paths associated with row times 26 and 27 as shown in FIG. 1. Because the electron beam is not energized by a video signal during either a horizontal retrace or vertical retrace, the individual horizontal retrace paths, such as 20 and 22, and the zig-zag vertical retrace path 30 are not visible on display screen 10.

It is to be appreciated that successive raster scans must occur at a sufficient rate to refresh the displayed information on the display screen 10 of FIG. 1. In the preferred embodiment, information on display screen 10 is refreshed approximately 60 times per second with the beginning of the next scan being triggered by the completion of the previous scan and with all timing being derived from a 19.712 megahertz oscillator as discussed hereinafter with respect to FIG. 4.

Figure 4:
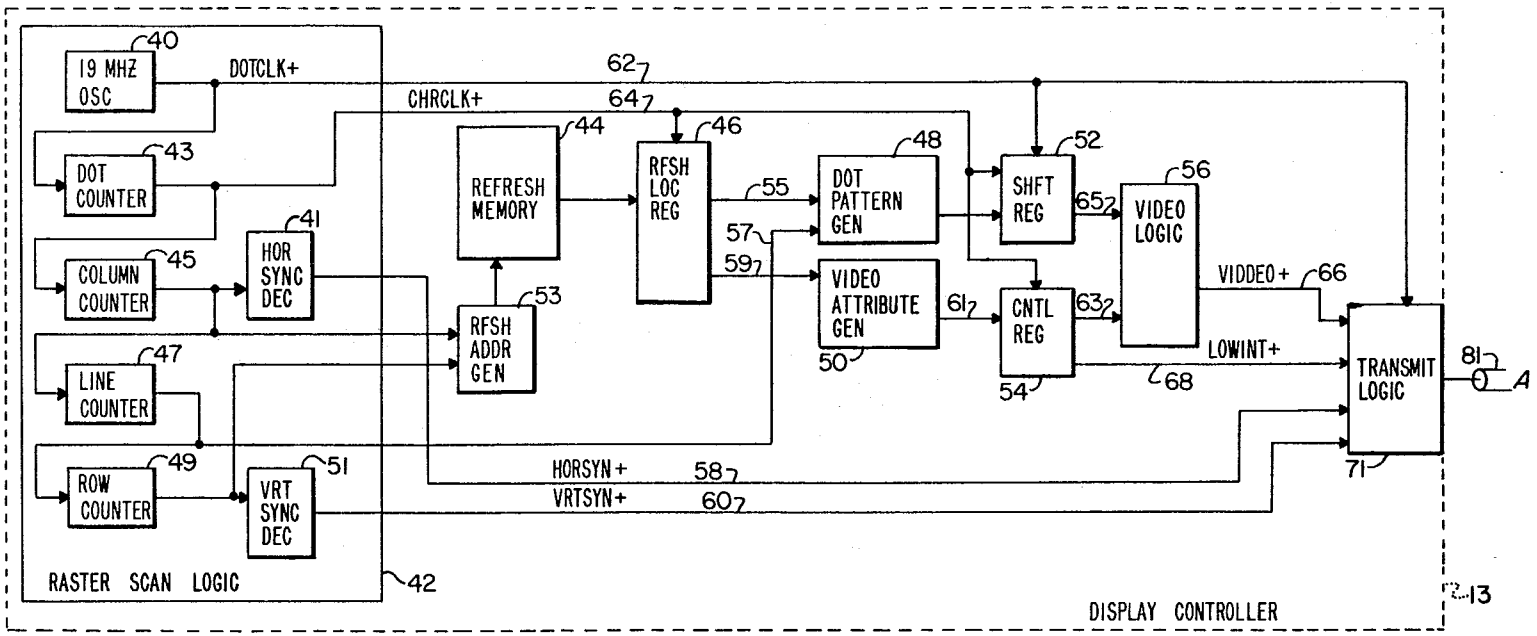
FIG. 4 is a block diagram of the display controller and display monitor logic used to form the video display of FIG. 1.
Figure 4:
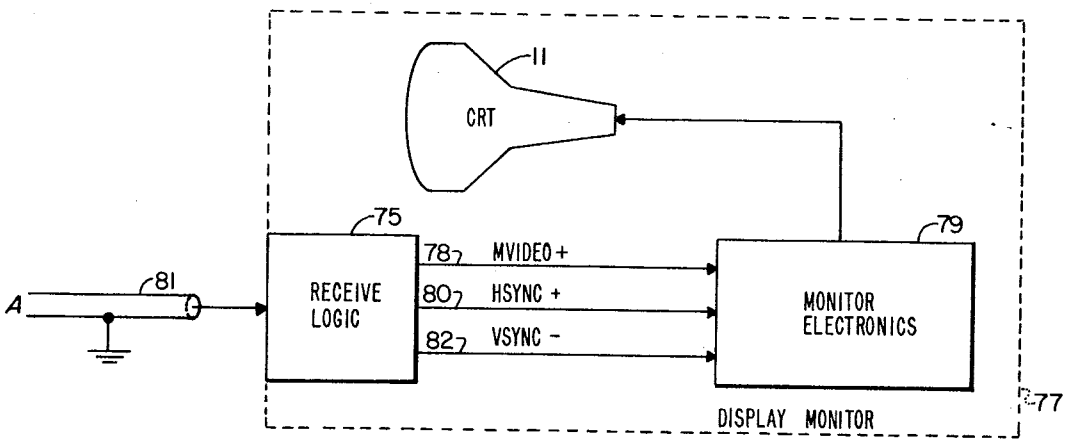

Referring now to FIG. 4, display controller 13 is operatively coupled to display monitor 77 via cable 81 such that the information contained in refresh memory 44 will be displayed on the screen of CRT 11. The exact manner in which this is accomplished will be apparent hereinafter.

The raster scan logic 42 controls the display of information through a dot clocking signal (DOTCLK+) via line 62, a character clocking signal (CHRCLK+) via line 64, a horizontal synchronization signal (HORSYN+) via line 58 and a vertical synchronization signal (VRTSYN+) via line 60. The information to be displayed on the screen of CRT 11 is retrieved from refresh memory 44 a character at a time and by the various logic of display controller 13 results in video logic 56 generating a video signal (VIDDEO+) on line 66. Along with each character of information to be displayed on the screen of the CRT 11, refresh memory 44 contains attribute information which affects how the character information is displayed on the screen of CRT 11.

In the preferred embodiment, each character of information may have the following attributes associated with the character: hide, blink, inverse video, underline and low intensity. If the hide attribute is selected, the character of information will not be displayed on the screen of CRT 11 although the character of information will remain unaffected in the refresh memory 44. If the blink attribute is selected, the character of information will be displayed on the screen of CRT 11 by flashing on and off as the image on the screen is refreshed. If the inverse video attribute is selected, the character will be displayed in the inverse video mode in which a dark character will be displayed against a light background. If the low intensity attribute is selected, the character of information will be displayed on the screen of CRT 11 in a low intensity level which is below that of the normal brightness of the character dots. If the underline attribute is selected, the character will be displayed on the screen with an underlining row of dots appearing in line 12 of the character cell 16 (see FIG. 2).

The hide, blink, inverse video and underline attributes affect the dot pattern display on the screen via video logic 56 and are reflected in video signal VIDDEO+. The low intensity attribute directly affects a low intensity signal (LOWINT+) on line 68. Video signal VIDDEO+ will be in its high state, or logical ONE state, when a dot on the screen of CRT 11 is to be generated by energizing the electron beam within display monitor 77. Low intensity signal LOWINT+ will be in the logical ONE state whenever the dots being displayed on the screen of CRT 11 are to be displayed in the low intensity (reduced brightness) mode.

The aforementioned illumination of dots occur while the electron beam is driven in a horizontal direction across the display screen 10. This is accomplished within the display monitor 77 by the beam drive circuitry of monitor electronics 79. This circuitry is responsive to the horizontal synchronization signal HSYNC+ on line 80 from receive logic 75 which is derived from the horizontal synchronization signal HORSYN+ on line 58 from raster scan logic 42 which is transmitted by transmit logic 71 on cable 81. The horizontal synchronization signal HSYNC+ appears on line 80 and is operative to initiate horizontal retrace of the electron beam as well as the subsequent horizontal scan of the individual lines by the electron beam. It is noted that the display controller 13 is operative to disable the generation of a high level video signal VIDDEO+ during such horizontal retraces such that the retrace pass is not visible on display screen 10.

The raster scan logic is also operative to initiate a vertical retrace of the electron beam within display monitor 77. A vertical retrace is initiated by vertical synchronization signal VRTSYN+ on line 60 from raster scan logic 42 going to a high state. The signal is transmitted by transmit logic 71 via cable 81 to receive logic 75 which in turn results in the video synchronization signal VSYNC− on line 82 going to a low level which in turn causes the vertical beam drive circuitry within monitor electronics 79 to move the electron beam back to the top of display screen 10. Logic within display controller 13 also inhibits the generation of a high level video signal VIDDEO+ during this vertical retrace thereby inhibiting the zig-zag vertical retrace pattern being visible on display screen 10.

It is to be understood that certain of the heretofore-mentioned elements within FIG. 4 are well known in the art and will therefore not be disclosed in detail herein. In particular it is to be noted that CRT 11 and monitor electronics 79 may be obtained commercially from Ball Brothers Research Corporation, Electronic Display Division, St. Paul, Minn. 55166.

The display controller 13 of FIG. 4 will now be discussed in further detail. Raster scan logic 42 provides a display controller 13 with dot times, character times, line times, and row times. The raster scan logic 42 begins with a continuous 19.712 megahertz oscillator 40 which drives dot counter 43. Oscillator 40 provides a dot clocking signal (DOTCLK+) on line 62 and also provides the input to dot counter 43. This dot time is input to dot counter 43 which divides the dot count by 9, which is the width of the character cell in dots per horizontal scan line, by generating a cyclical dot count of 0 through 8 to produce a character clocking signal (CHRCLK+) on line 64. This character time is input to column counter 45 which divides the column count by 104, which is the number of columns in a horizontal scan line (see FIG. 1), by generating a cyclical count of 0 through 103. The column count output by column counter 45 is input to horizontal synchronization decoder 41 which decodes column counts 80 through 103 and generates a horizontal synchronization signal (HORSYN+) on line 58. Signal HORSYN+ is in the low state during column counts 0 through 79 (corresponding to columns 1 through 80 of FIG. 1) when information is to be displayed on display screen 10 and in the high state during column counts 80 through 103 (corresponding to columns 81 through 104 of FIG. 1) when the horizontal retrace is to occur. The output of column counter 45 is also input to line counter 47 which divides the line count by 13, which is the number of lines per row (character cell, see FIG. 2) by generating a cyclical count of 0 through 12. The output of line counter 47 is input to row counter 49 which divides the row count by 27, which is the number of rows in a vertical scan of the display screen (see FIG. 1), by generating a cyclical count of 0 through 26. The row count output by row counter 49 is input to vertical synchronization decoder 51 which decodes row counts 25 and 26, and generates a vertical synchronization signal (VRTSYN+) on line 60. Signal VRTSYN+ is in the low state during row counts 0 through 24 (corresponding to rows 1 through 25 of FIG. 1) when information is displayed on display screen 10 and in the high state during row count 25 and 26 (corresponding to rows 26 and 27 of FIG. 1) when the vertical retrace is to occur.

Thus as described hereinbefore, the first 80 column counts represent characters actually displayed on the display screen 10 and the next 24 counts are used for the horizontal retrace and do not cause characters to be displayed. The first 25 rows of characters represent rows which are displayed on a display screen 10 and the last 2 rows are used during the vertical retrace time.

The column count output by column counter 45 and the row count output by row counter 49 are input to refresh address generator 53 which generates an address in refresh memory 44 which identifies which memory location within the refresh memory containing the character information and attribute information associated with the character which is to be displayed for a particular character cell. The 16-bit words are read from refresh memory 44 and clocked into refresh local register 46 by character clocking signal CHRCLK+. Seven bits of each 16-bit word are used to contain the ASCII code for the character which is to be displayed on the screen and are fed to dot pattern generator 48 on line 55 to get the dot pattern of a line within the dot matrix associated with the information character to be displayed. The output of line counter 47 on line 57 is also input to dot pattern generator 48 so that the dot pattern associated with each particular line of the character cell can be generated as the horizontal scan progresses from scan line to scan line. The output of pattern generator 48 is loaded into shift register 52 by character clocking signal CHRCLK+ on line 64. After the dot pattern associated with the current line of the character cell is loaded into shift register 52, it is shifted one dot at a time by dot clocking signal DOTCLK+ on line 62 so that the output signal on line 65 follows the horizontal scan of the electron beam as it progresses across the dots of the character cell. Other bits from the 16-bit word from refresh memory 44 indicates the video attributes associated with the character and are fed from refresh local register 46 on line 59 into video attribute generator 50. Video attribute generator 50 provides output signals which indicate: normal video, inverse video, and intensity level. These video attribute signals on line 61 are clocked into control register 54 by character clocking signal CHRCLK+ because these signals remain constant for each of the 9 dots associated with the horizontal scan line of a particular character cell. The normal and inverse video control signals on line 63 are combined along with the output of shift register 52 on line 65 by video logic 56 to provide a video signal (VIDDEO+) on line 66. This video signal VIDDEO+ is clocked into transmit logic 71 by dot clocking signal DOTCLK+ along with the low intensity signal from control register 54, and the horizontal synchronization signal HORSYN+ and the vertical synchronization signal VRTSYN+ from raster scan logic 42. These four TTL level signals are converted into signal levels suitable for transmission over cable 81 to receive logic 75 which converts the signals back to TTL level signals and generates a modulated video signal MVIDEO+, and horizontal synchronization signal HSYNC+ and vertical synchronization signal VSYNC−. This conversion from TTL level signals before transmission over cable 81 and reconversion to TTL level signals after transmission over cable 81 is necessary because of the fact that cable 81 exceeds the relatively short distance of 1 or 2 feet over which TTL level signals can be reliably transmitted.

Before describing transmit logic 71 and receive logic 77 in detail, a critical design objective will be discussed. In the transmission of multiple signals between two points, it is particularly important that the synchronization between the signals be maintained. In the preferred embodiment, in which four signals are transmitted from display controller 13 to the display monitor 77, it is important that the synchronization between the video, intensity, horizontal synchronization and vertical synchronization signals be maintained. This is particularly the case for high resolution display monitors of the type employed in the preferred embodiment of the instant invention if the characters of information displayed on the screen are to be stable, clear and clean and not fuzzy. In the preferred embodiment, the time it takes for the horizontal scan of the electron beam to scan the length of one dot of the character matrix is approximately 50.7 nanoseconds, this time representing the outer limits by which the signal may be out of synchronization without seriously affecting the clarity of the image on the display screen. As discussed hereinafter, empirical tests have shown that the maximum permissible missynchronization, or skew, of the signals is in fact 16 nanoseconds from dot scan times of 50.7 nanoseconds.

Figure 5A:
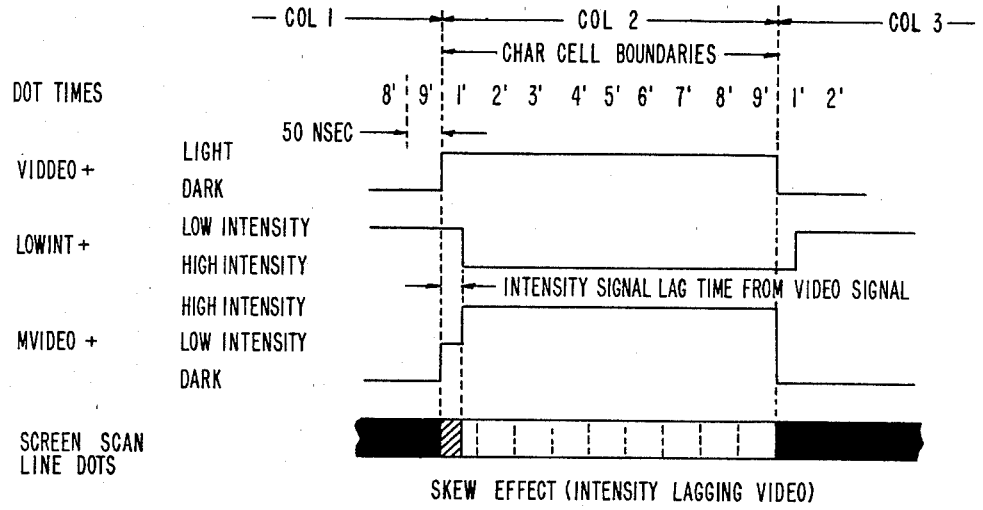
FIGS. 5A and 5B are diagrams illustrating the effect of skew between the video signal and intensity signal on a horizontal scan line of the character cell of FIG. 2.
Figure 5B:
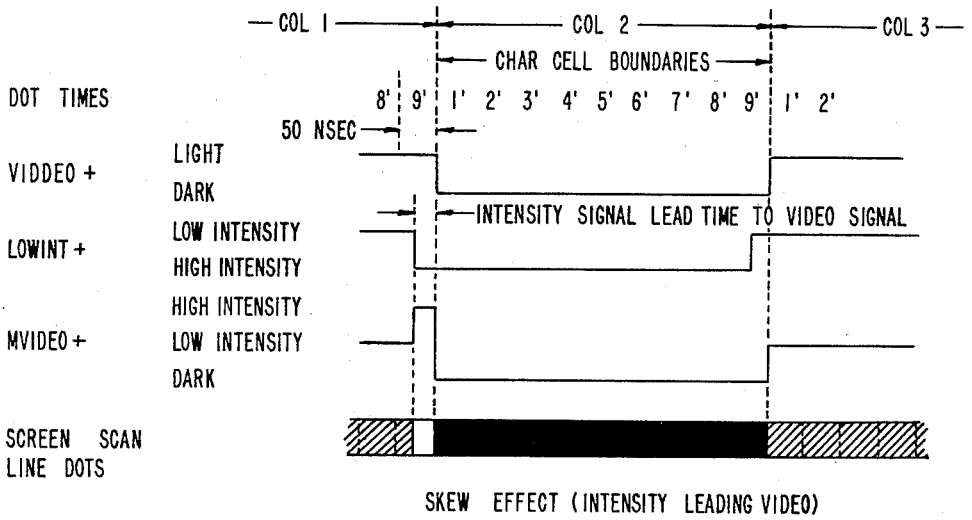

Within the preferred embodiment, the maintenance of synchronization between the video signal and the intensity signal is the most critical. Now referring to FIGS. 5A and 5B, two cases of signal skew will be discussed. FIG. 5A illustrates the case in which the intensity signal lags the video signal and FIG. 5B illustrates the case in which the intensity signal leads the video signal.

Referring now to FIG. 5A, the case in which the intensity signal lags the video signal will be discussed. In this case, the video signal arrives first and turns the video on to the low intensity state associated with the previous character cell, and sometime later the high intensity signal for the current character cell arrives. This results in the first dot of the current character cell being displayed in two intensities (low then high). FIG. 5A illustrates the dot times associated with: a trailing edge of a character cell in column 1 of display screen 10 (see FIG. 1), a full character cell in column 2, and a leading edge of a character cell in column 3. Video signal VIDDEO+ found on line 66 of FIG. 4 is illustrated such that when the signal is in the low state, logical ZERO, the electron beam of CRT 11 will not illuminate a dot on the display screen 10 and when in the high state, logical ONE, will illuminate a dot on display screen 10. Intensity signal LOWINT+ is illustrated such that when the signal is in the high state, logical ONE, any dot being displayed on the screen is to be displayed in low intensity (medium brightness) and when in the low state, logical ZERO, any dot being displayed on the screen is to be displayed in the high intensity (full brightness). Modulated video signal MVIDEO+ is a signal found on line 78. Signal MVIDEO+ is a composite of the video and intensity signals and is generated by receive logic 75 as will be discussed hereinafter with respect to FIG. 6.

Although the monitor electronics 79 used in the preferred embodiment is designed to have a video input signal in either a high state or a low state, thereby producing an image on the display screen 10 of CRT 11 in either a dark (no illumination) or light (full brightness) dots, it has been found that by biasing the video input signal into an intermediate voltage level between the voltage level used to indicate a dark dot on the screen and the voltage level used to indicate a full brightness dot on the screen that a dot of intermediate intensity can be generated. Thus a low voltage level video signal produces no dot on the screen (i.e., a dark dot), an intermediary voltage level produces a low intensity (medium brightness) dot and a high voltage level produces a high intensity (full brightness) dot on the display screen. Thus in the preferred embodiment, modulated video signal MVIDEO+ when in the high voltage range of 3.0 to 4.0 volts DC will produce a high intensity (full brightness) dot on the screen, when in the low voltage range of 0.0 to 0.4 volts DC will produce a no dot (dark dot) on the screen, and when at an intermediate voltage level between 0.4 and 4.0 volts DC will produce a low intensity (medium brightness) dot on the screen. The exact voltage level used as input to the monitor electronics 79 for the low intensity video signal is determined by adjusting a variable resistor as discussed hereinafter with respect to FIG. 6.

The screen scan line dots illustrated in FIG. 5A represent the horizontal scan line of dots formed on the display screen 10 of CRT 11 as a result of monitor electronics 79 receiving the illustrated modulated video signal MVIDEO+. In the scan line of dots, those portions of the scan line illustrated in black will be displayed as dark spots on the display screen, those portions illustrated by hash marks will be displayed in low intensity on the display screen and those portions illustrated in white will be displayed in high intensity on display screen 10.

As illustrated in FIG. 5A, the video signal VIDDEO+ corresponds to the case in which dots 1' through 9' in column 2 are to be light and dots 8' and 9' of column 1 and dots 1' through 2' of column 3 are to be dark. Referring now to FIG. 2, it can be appreciated that this video signal corresponds to the case in which the underline line, line 12 of the character cell, is being scanned and the character in column 1 is not underlined, the character in column 2 is underlined, and the character in column 3 is not underlined. This case is chosen because the critical problems between the synchronization of the intensity and video signals occur at the character cell boundaries and the underlining of a character is a case in which dots in 1' and 9' are illuminated. In the preferred embodiment, the most critical case occurs in the dots along the character cell boundaries because the intensity signal only changes at the character cell boundaries since the all dots within a character cell are displayed at the same intensity level. That is, within a given character cell the matrix is composed of either high intensity dots and dark dots or of low intensity dots and dark dots.

Referring to the low intensity signal in FIG. 5A, signal LOWINT+, it can be appreciated that the character in column 1 is to be displayed in low intensity, the character in column 2 is to be displayed in high intensity, and the character in column 3 is to be displayed in low intensity. Although in the preferred embodiment the low intensity signal will either be in the high state or low state for the full width of a character cell, the video signal may in fact change between the light state and the dark state on an individual dot basis and is illustrated as being in the dark state for column 1 and column 3 and in the light state for column 2 because that is the shape of the video signal associated with the line 12 of the character cell for an underlined character which is surrounded by 2 characters which are not underlined.

FIG. 5A illustrates the case in which the intensity signal is skewed with respect to the video signal such that the intensity signal does not change state at the character cell boundaries but instead lags behind the video signal for approximately half the scan time of dot 1'. As will be seen hereinafter in the discussion of receive logic 75 in FIG. 6, the modulation of the video signal by the intensity signal will result in the modulated video signal MVIDEO+ shown in FIG. 5 in which the signal goes from the dark state to the low intensity state for the first half of dot 1' of column 2 and then goes to the high intensity state for the remainder of dot 1' and through dot 9' of column 2. It should be further noted that the modulated video signal MVIDEO+ changes from the high intensity state to the dark state at the character cell boundary between column 2 and column 3 in response to the video signal going from the light to the dark state. Thus it can be appreciated that the presence of the video signal in the light state will cause the modulated video signal MVIDEO+ to be either in the low intensity or the high intensity state. It is the intensity signal LOWINT+ which controls which of the two intensities the modulated video signal is in. Referring now to the scan line dots which will appear on display screen 10, it can be appreciated that the dots associated with column 1 will be dark (black in FIG. 5A) as will those associated with column 3. The dots associated with column 2, all of which will be displayed as high intensity (full brightness) dots if the video and intensity signals were in proper synchronization, will actually be displayed with the first half of the 1' dot being displayed in low intensity (hash mark in FIG. 5A) and the remainder of dots 1' through 9' being displayed in high intensity (white in FIG. 5A).

Turning now to FIG. 5B, a case similar to that illustrated in FIG. 5A will be discussed. However in this case, the intensity signal arrives first and changes the video which is already on from the low intensity state associated with the current character cell to the high intensity state associated with the next character cell, and sometime later the video signal arrives for the next character cell and turns off the video. Also the video signal in FIG. 5B is the inverse of the video signal in FIG. 5A. Thus if the video signal in FIG. 5B is again to be associated with line 12 of a character cell, the underline line, the video signal VIDDEO+ in FIG. 5B, illustrates the case in which column 1, column 2 and column 3 are displayed in the inverse video mode (i.e., dark characters are displayed against a light background) with the character in column 2 being underlined and surrounded by characters in column 1 and 3 which are not underlined. The intensity signal LOWINT+ in FIG. 5B again illustrates the case (as is in FIG. 5A) in which the characters in columns 1 and 3 are to be displayed in low intensity and the character in column 2 is to be displayed in high intensity.

As in FIG. 5A, the modulated video signal in FIG. 5B, signal MVIDEO+, is generated by receive logic 75 by combining the video (VIDEO+) and the intensity (LOWINT+) signals. The resultant modulated video signal shows that the dots associated with column 1 will be displayed in low intensity with the exception of the last half of dot 9' which will be displayed in high intensity because the low intensity signal went to the high intensity state before the video signal went to the dark state. FIG. 5B also shows that all of the dots associated with column 2 will be displayed in the dark state and the beginning dots associated with column 3 will be displayed in the low intensity. Dot 1' of column 3 is not affected by the missynchronization of the intensity signal with the video signal because the proper intensity signal level is established before the video signal changed from dark to light.

By referring to the screen scan line dots of FIG. 5A and FIG. 5B, it can be appreciated that if the intensity signal is skewed with respect to the video signal such that it lags the video signal the beginning dots of a character cell may be affected. If the intensity signal leads the video signal, the trailing dots of a character cell will be affected. In the preferred embodiment, in which the time to horizontally scan the length of one dot of a character cell is approximately 50.7 nanoseconds, it has been found, by empirical tests in which the skew between the intensity signal and the video signal could be controlled, that if the video signal and the intensity signal are not within 16 nanoseconds of synchronization that the resultant fuzziness caused by having a dot illuminated with a portion in high intensity and a portion in low intensity becomes visually objectionable to an observer. It should be noted that the degree of distortion (fuzziness) acceptable to the display screen observer is a subjective measurement.

Figure 6:
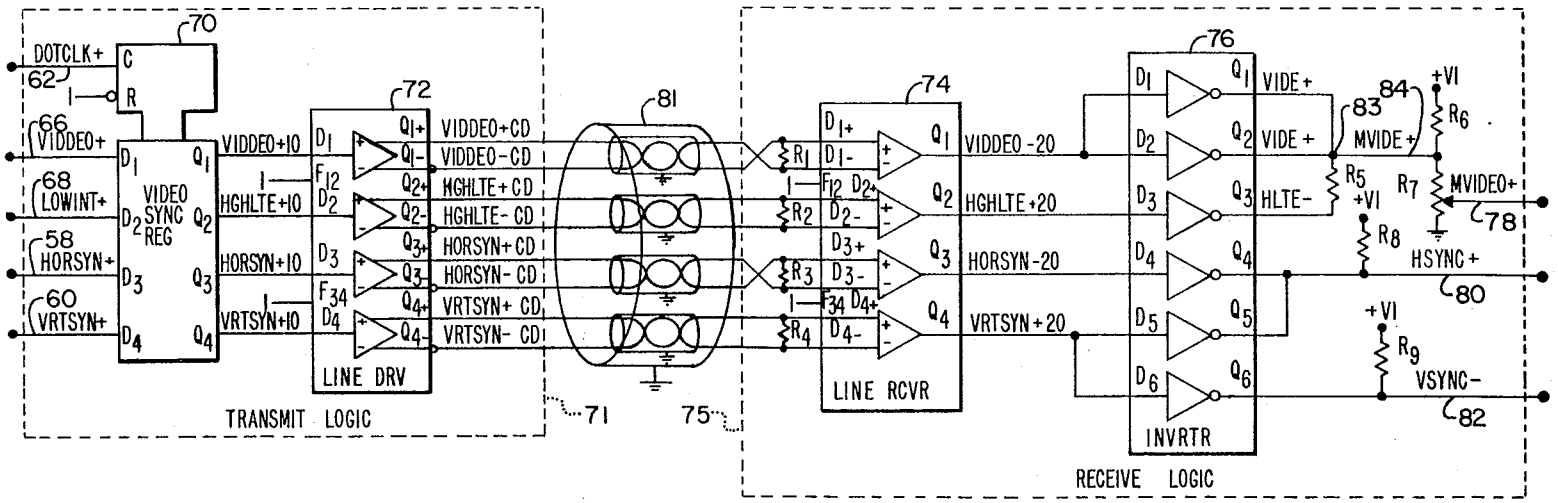
FIG. 6 is a detailed illustration of the transmit logic and receive logic of FIG. 4.

Referring now to FIG. 6, the transmit logic 71 and receive logic 75 will now be discussed in detail. Video synchronization register 70 and line driver 72 comprise transmit logic 71. A set of resistors which terminate cable 81, resistors R1 through R4, line receiver 74, inverter 76, and a second series of resistors R5 through R9 comprise receive logic 75. Transmit logic 71 takes the four information signals: video, intensity, horizontal sync, and vertical sync and transmits them to receive logic 75 via cable 81 in parallel. Receive logic 75 takes these four input signals from the display controller and maintains the synchronization between the signals, and via the second set of resistors R5 through R9, produces the three signals required as inputs to monitor electronics 79. Receive logic 75 takes the four input signals and produces the three output signals by combining the video and intensity signals into a modulated video signal (MVIDEO+) and basically passes the horizontal sync and vertical sync signals through unaltered. Thus, transmit logic 71, cable 81, and receive logic 75 are designed such that the synchronization between the signals is established in transmit logic 71 and maintained without resynchronization such that the output of receive logic 75 has maintained the synchronization between the signals within the 16 nanoseconds maximum skew limit as discussed hereinbefore with respect to FIG. 5A and FIG. 5B.

Video synchronization register 70 has as inputs: video signal VIDDEO+ on line 66, intensity signal LOWINT+ on line 68, horizontal synchronization signal HORSYN+ on line 58, and vertical synchronization signal VRTSYN+ on line 60. These four signals are clocked into the video synchronization register 70 by the dot clocking signal DOTCLK+ on line 62 transitioning from the logical ZERO to logical ONE state. In the preferred embodiment, video synchronization register 70 is a single integrated circuit comprised of multiple D-type flip-flops each of which is clocked by a common clocking (C) input signal and clearable by a common reset (R) input signal. As illustrated in FIG. 6, the reset input of video synchronization register 70 is maintained as a logical ONE such that the transition of the clocking signal from a logical ZERO to a logical ONE state will clock the inputs (D1–D4) of the D-type flip-flops to their corresponding outputs (Q1–Q4). In the preferred embodiment, video synchronization register 70 is a type SN74S174 D-type flip-flop manufactured by Texas Instruments Inc. of Dallas, Texas and is described in their publication entitled, *The TTL Data Book for Design Engineers*, Second Edition. This type SN74S174 integrated circuit actually contains six D-type flip-flops but only four are used in the synchronizing of the signals before they are presented to line driver 72.

The signals output by video synchronization register 70, video signal VIDDEO+10, low intensity signal HGHLTE+10, horizontal synchronization signal HORSYN+10, and video synchronization signal VRTSYN+10, are in turn the inputs of line driver 72. Line driver 72 is a single integrated circuit which contains four independent driver chains which comply with EIA standards for electrical characteristics of balanced voltage digital interface circuits. The outputs of line driver 72 (Q1+ through Q4−) are three-state structures which are forced to a high impedance state when the corresponding function (F) input is a logical ZERO. In the preferred embodiment, function input F12, which controls the output of drivers 1 and 2, and function input F34, which controls the output of drivers 3 and 4, are set to a logical ONE such that the output of the driver is either a logical ZERO or a logical ONE and never in the third state (high impedance). In the preferred embodiment, line driver 72 is a type MC3487 integrated circuit manufactured by Motorola Inc. of Phoenix, Ariz. 85036.

Each driver of line driver 72 takes the TTL compatible input (D1 through D4) and produces two balanced voltage outpus (Q1+ and Q1− through Q4+ and Q4−) which are transmitted by cable 81 to receive logic 75. If the Q+ output of each driver is in the same state as the input to the driver and the Q− output is the inverted output and it is in the opposite state of the input. The outputs of line driver 72, the four pairs of signals VIDDEO+CD and VIDDEO−CD, HGHLTE+CD and HGHLTE−CD, HORSYN+CD and HORSYN−CD, and VRTSYN+CD and VRTSYN−CD which correspond respectively to the input signals VIDDEO+10, HGHLTE+10, HORSYN+10, and VRTSYN+10 are transmitted from transmit logic 71 to receive logic 75 via cable 81. Cable 81 comprises four pairs of twisted wire leads. Each of these pairs of twisted wire leads is terminated at the receive logic 75 by a resistor (R1 through R4). In the preferred embodiment, the value of the resistors R1 through R4 is 100 ohms which matches the characteristics impedance of the twisted wire transmission line of cable 81 thereby preventing reflection of the signal in cable 81. After being terminated by terminating resistors R1 through R4, the four pairs of balance voltage signals are then input to line receiver 74.

Line receiver 74 is a single integrated circuit which contains four independent receiver chains which comply with EIA standards for electrical characteristics for balanced/unbalanced voltage digital interface circuits. The outputs of line receiver 74 (Q1 through Q4) are three-state structures which are forced to a high impedance state if the corresponding function input signal (F12 or F34) is in a logical ZERO state. In the preferred embodiment, function (F) inputs F12 and F34 are maintained in the logical ONE state and therefore Q1 and Q4 will be either in a logical ONE or logical ZERO state depending upon their corresponding inputs (D1+ and D1− through D4+ and D4−). In the preferred embodiment, line receiver 74 is a type MC3486 integrated circuit manufactured by Motorola Inc. of Phoenix, Ariz. 85036.

FIG. 6 shows that the balance voltage outputs for the video signal and the horizontal synchronization signal are interchanged at the inputs of line receiver 74 such that if the video signal VIDDEO+10 is in the logical ONE state at input D1 of line driver 72 the corresponding signal VIDDEO−20 at output Q1 of line receiver 74 will be in the logical ZERO state. Similarly signal HORSYN+10 at input D3 of line driver 72 is inverted with respect to its corresponding signal HORSYN−20 at output Q3 of line receiver 74. This invention of signals between the inputs of line driver 72 and the outputs of line receiver 74 by interchanging the balanced voltage input signals is done in order to provide signals of the required logical state at the inputs of inverter 74 and thereby eliminates any requirement for any other inverting logical element between the outputs of video synchronization register 70 and the inputs of inverter 76.

The four TTL level signals from line receiver 74 are fed into inverting amplifier 76 which provides signals at the levels required for inputs into monitor electronics 79. The primary purpose of inverting amplifier 76 is to amplify the signals from receiver 74, the inverting funtion could be done by reversing the polarity of the outputs of transmitter 72 with the inputs of receiver 74 as described hereinbefore with respect to signals VIDDEO+CD and VIDDEO−CD and signals HORSYN+CD and HORSYN−CD. Inverter 76 is a single integrated circuit containing six open-collector inverting amplifiers. Open-collector inverting amplifiers are used so that the low intensity signal appearing at the Q3 output of inverter 76 may be effectively subtracted from the video signal appearing at the Q1 and Q2 outputs of inverter 76 thereby providing the modulated video signal MVIDE+ on line 84. Video signal VIDDEO−20 is input to two inverters in parallel with the inverted output appearing at the Q1 and Q2 outputs of inverter 76. Two parallel inverters are used to invert the video signal so that the current flowing through each individual inverter is less than the maximum current allowable for an individual inverter. In the preferred embodiment, voltage V1 is 5 volts DC and resistor R6 is 150 ohms. The output of the inverted video signal, signal VIDE+ at the Q1 and Q2 outputs of inverter 76, is combined with the inverted low intensity signal, signal HLTE− at the Q3 output of inverter 76 at point 83. Video signal VIDE+ will be a logical ONE if a dot is to appear on display screen 10. Low intensity signal HLTE− will be a logical ZERO if the dots (all the illuminated dots in the character cell) are to be displayed on the display screen 10 in the low intensity mode and a logical ONE if the dots are to be displayed on the screen in the high intensity mode.

Combining the video signal VIDE+ with the low intensity signal HLTE− via resistor R5 at point 83 results in a modulated video signal MVIDE+ on line 84. In the preferred embodiment, resistor R5 is a 510 ohms resistor. Signal MVIDE+ on line 84 is a modulated video signal in that it is in: a high level when the video is to be displayed on the display screen 10 at full intensity, an intermediate level when the video is to be displayed on display screen 10 in an intermediate (low) intensity, and a low level when no video is to be displayed on display screen 10. This three-level modulated video signal was discussed hereinbefore with respect to FIGS. 5A and 5B. Ignoring for a moment the effect of low intensity signal HLTE−, the video signal MVIDEO+ which is supplied to the monitor electronics 79 on line 78 would normally be a high or low level signal as a function of the video signal VIDE+ at the Q1 and Q2 outputs of open-collector inverter 76 and also as a function of resistor divider network R6 and R7. In the preferred embodiment, R6 is a 150 ohms resistor and R7 is a 500 ohms variable resistor. The effect of the low intensity signal is such that, if the low intensity signal HLTE− is a logical ZERO (low voltage) at the Q3 output of open-collector inverter 76 and the video signal VIDE+ at the Q1 and Q2 outputs of inverter 76 is a logical ONE (high voltage), current will flow through resistor R5 and reduce the voltage level at point 83 and on line 84 thus producing an intermediate voltage level modulated video signal MVIDE+. If signals HLTE− and VIDE+ are both logical ONEs (high voltage levels) indicating that a dot is to be illuminated at full brightness, no current flows through resistor R5 and modulated video signal MVIDE+ will be a high voltage level signal. In the preferred embodiment, R5 is a 510 ohms resistor. Variable resistor R7 is used to adjust the contrast between the high and low intensity dots generated on the face of display screen 10. Resistor R7 is adjusted such that the voltage level of the modulated video signal MVIDEO+ for a low intensity dot is biased to the threshold of the circuit in the monitor electronics 79 which is used to drive the video of CRT 11. This biasing of the low intensity voltage level to the threshold of the electron beam drive circuitry is necessary because in the preferred embodiment the particular monitor electronics 79 are designed for a single (adjustable for linear mode) video input. By biasing the low intensity voltage level between the light and dark voltage levels, a low intensity dot can be generated.

Horizontal synchronization signal HORSYN−20 is inverted by two parallel open-collector inverters and the output thereof at outputs Q4 and Q5 of inverter 76, signal HSYNC+ on line 80, is the horizontal synchronization signal input to monitor electronics 79. Signal HSYNC+ is a logical ONE (high voltage level), as required by the monitor electronics 79, during the time in which the horizontal retrace is taking place and a logical ZERO (low voltage level) during the time that the horizontal scan line is displaying information on display screen 10. Again, as in the case of the video signal, two parallel open-collector inverters are used so that the current in each inverter does not exceed the maximum allowable current rating of the individual inverters. In the preferred embodiment, resistor R8 is a 330 ohms resistor and again voltage V1 is +5 volts DC.

Vertical synchronization signal VRTSYN+20 is inverted by inverter 76 and produces signal VSYNC− on line 82 at the Q6 output. Vertical synchronization signal VSYNC− is a logical ONE (high voltage level) when information is being displayed on display screen 10 and in the logical ZERO (low voltage level) during the vertical retrace of the electron beam from the bottom scan line to the top scan line of display screen 10. In the preferred embodiment, resistor R9 is a 470 ohms resistor and again voltage V1 is +5 volts DC.

The logical states (ONE and ZERO) and their corresponding voltage levels of the modulated video (MVIDEO+), horizontal synchronization (HSYNC+), and vertical synchronization (VSYNC−) signals required by monitor electronics 79 are a function of the particular monitor electronics 79 employed within a given embodiment. In the preferred embodiment, modulated video signal MVIDEO+ is used by the monitor electronics to control one of the grids within CRT 11 to determine whether or not the display screen 10 is modulated to the light state or the dark state. The two brightness levels of dots on display screen 10 is achieved by biasing the video signal into a threshold region such that when a low intensity dot is required only a partial beam is generated by CRT 11. Horizontal synchronization signal HSYNC+ controls the horizontal deflection circuitry within the monitor electronics such that the electron beam is controlled to produce the horizontal scan lines and the horizontal retrace. The vertical synchronization signal VSYNC− drives the vertical deflection circuitry within monitor electronics 79 and controls the vertical deflection of the electron beam as the horizontal scan lines progress down the face of the CRT of the display screen 10 followed by the vertical retrace from the bottom to the top scan lines.

Before describing the characteristics of cable 81, it should be noted how the design of transmit logic 71 and receive logic 75 contribute to the minimization of the skew between the various signals. As discussed hereinbefore, subjective tests determined that the total amount of skew allowable in the transmission of the signals from the display controller 13 to the monitor electronics 79 was 16 nanoseconds. This total amount of 16 nanoseconds signal skew is composed of: the skew due to transmit logic 71, the skew due to cable 81, and the skew due to receive logic 75. Transmit logic 71 and receive logic 75 are designed to minimize skew by passing all transmitted signals through single integrated circuit elements and by choosing elements with fast switching times to minimize signal propagation delay. The use of single integrated circuits insures that all gates within the integrated circuit are as close to the same temperature and voltage level as possible. It should be noted that the temperature and the voltage level may vary from place to place on a printed circuit board and both temperature and voltage level will affect the switching times of the various gates within integrated circuits.

Passing all signals through this series of single integrated circuits also minimizes the difference in propagation delay in individual gates by using all gates within a single integrated circuit as opposed to using some gates in one integrated circuit for one signal and some gates in another integrated circuit for a second signal. For example, in the preferred embodiment, if the video synchronization register 70 was comprised of two parallel integrated circuits, as opposed to the one single integrated circuit actually used, and the video signal VIDDEO+ was input to one integrated circuit and the low intensity signal LOWINT+ was input to a second integrated circuit, there is the possibility that the skew between these two signals would be increased due to the different propagation delays introduced by the gates of the first integrated circuit with respect to those of the second integrated circuit.

This difference in propagation delay between the gates of separate integrated circuits is due to the process by which the integrated circuits are manufactured and the tolerances allowable for the propagation delay of a given integrated circuit type to still be within acceptable performance specifications. For example, a typical propagation delay time for switching from a low level to a high level output for the D-type flip-flops of video synchronization register 70 may be 8 nanoseconds with a maximum propagation delay of 12 nanoseconds. Therefore, if the video signal VIDDEO+ is being switched by a first integrated circuit with a typical propagation delay time of 8 nanoseconds and the low intensity signal LOWINT+ is being switched by a second integrated circuit with a propagation delay time of the maximum of 12 nanoseconds, the skew introduced between these two signals due simply to the fact that they are in two separate integrated circuits is 4 nanoseconds. This typical 30 to 50 percent difference in propagation delay between integrated circuits of the same type is eliminated by passing all signals through a single integrated circuit in which the propagation delay between gates within the same integrated circuit is in the range of less than 5 percent.

The use of single integrated circuits for all signals also has the secondary advantage in that it makes signal etch runs on the printed circuit boards of approximate equal length thereby minimizing the amount of skew due to different length signal runs. The skew is further reduced by integrated circuits with fast switching characteristics. For example, a 5 percent tolerance within an integrated circuit switching with a propagation delay time of 20 nanoseconds results in a possible one nanosecond skew between signals, whereas an integrated circuit with a propagation delay time of 10 nanoseconds results in a possible 0.5 nanosecond skew between signals.

In the preferred embodiment, there are two types of cable 81 used. For lengths of 0 to 75 feet, cable 81 is comprised of 4 pairs of twisted wires with an outer shielding around the four pairs of wires. For a cable length of 75 to 150 feet, cable 81 is comprised of four pairs of individually shielded wires with an outer shield around the four inner shields. In both these cases the outer shielding is grounded and primarily serves the purpose of reducing RFI emissions from the cable caused by the rapidly switching signals carried by the four twisted pairs. In both the short run, less than 75 feet, and the long run, over 75 feet, it is important that the length of the signal paths of the twisted pairs be approximately equal to minimize skew introduced by different signal path lengths.

In cable 81 of 75 to 150 feet, the individual twisted pairs of wires are individually shielded as illustrated in FIG. 6 to minimize the effect of signals in one pair switching in one direction (for example: high to low) and signals in another pair switching in the other direction (for example: low to high). Without shielding the individual pairs, a signal switching in one pair will speed up the switching of a signal in another pair switching in the same direction and will slow down the switching of a signal switching in the opposite direction in another pair. This reinforcing and inhibiting of switching between signals running in parallel conductors is caused by capacitance build-up in the cable and is a function of cable length. The shielding of individual twisted pairs helps reduce this capacitance build-up. Empirical tests, in which the skew due to transmit logic 71 and receive logic 75 have been accounted for, have shown that the individual shielding is not needed for cable lengths of less than 75 feet and is required for cable lengths of 75 to 150 feet.

Another factor determining the choice of cable and the maximum length which the cable is suitable is the capacitance of the pair of twisted wires itself. Capacitance increases with the length of the cable and directly affects the charging and discharging time of the signal levels. As the charging and discharging time increases, the signal wave shape, which would otherwise be a square wave, is distorted as the signal level charges up exponentially and discharges exponentially. This charging and discharging time introduced by cable capacitance delays a signal reaching the voltage level threshold required by the receiving circuit to switch from one state to another state. If all signals are switching at the same frequency, the charging and discharging time of each signal will be the same, and no skew will be introduced between the signals. However, a fast switching signal will not have time to fully charge or discharge the twisted pair and will result in the reaching of the threshold voltage level of the receiving circuit earlier than a signal switching at a lower frequency and thus introduce skew between the signals. For example, in the preferred embodiment, the video signals VIDDEO+CD and VIDDEO−CD can switch each dot time which is approximately 50.7 nanoseconds whereas the low intensity signals HGHLTE+CD and HGHLTE−CD may only switch at one-ninth that frequency (i.e., each character cell boundary, approximately 456.3 nanoseconds each), resulting in the fact that the cable capacitance can introduce skew between the video and low intensity signals. Thus the capacitance of the cable is a factor in determining the choice of cable.

The video generation logic of FIG. 7 will now be discussed in detail. As discussed with respect to FIG. 4, the information to be displayed on the CRT 11 is retrieved from refresh memory 44 a character at a time (see FIG. 4). In the preferred embodiment, refresh memory 44 is a random access memory containing 2,048 words of 16 bits each. Of these 2,048 data locations contained in refresh memory 44, 2,000 data locations are used to contain the 2,000 characters (80 display columns times 25 display rows) displayable on CRT 11 (see FIG. 1). The format of the 16-bit refresh memory data word is shown in FIG. 8.

Figure 8:
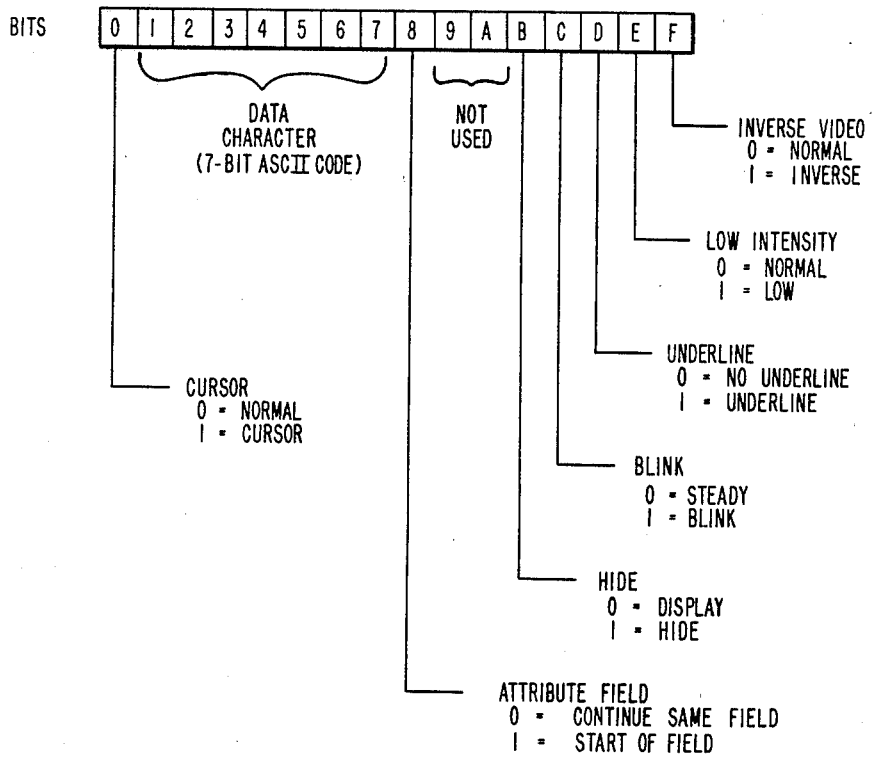
FIG. 8 is a diagram illustrating the data format of information stored in the refresh memory of the display controller.

Referring now to FIG. 8, it can be seen that bit 0 is used for cursor control. If bit 0 is a logical ZERO, the character position on the display screen corresponding to the refresh memory data word does not contain the cursor. If bit 0 is a logical ONE, the character position on the display screen of CRT 11 contains the current position of the cursor. The cursor indicates to an operator where the next character of data entered from a keyboard attached to the display controller will be placed. Bits 1 through 7 are used to store the 7-bit ASCII code which corresponds to the data character.

Bit 8 is used as an attribute field indicator. If bit 8 is a logical ZERO, it means that the data character is part of a multiple character field having all common video attributes such that the attribute bits of the 16-bit data word in refresh memory 44 of the first word of the multiple character field are to be used and the attribute bits in the current character's 16-bit data word are to be ignored. If bit 8 is a logical ONE, it means that this data character is start of a field having common video attributes and the video attributes found in bits B through F are to be used. Each character can have a unique set of video attributes by setting bit 8 to a logical ONE to indicate that each character starts a new attribute field. As will be seen below, bit 8 does not affect the interpretation of the cursor bit (bit 0) such that a cursor in a mulitple character field will always be displayed.

Bits 9 and A (hexadecimal notation) are not used. Bit B is used for the hide attribute. If bit B is a logical ZERO, the data character is to be displayed on the display screen. If bit B is a logical ONE, the data character is not to be displayed on the display screen. Bit C is the blink control bit. If bit C is a logical ZERO, the character is to be displayed on the display screen in a steady (non-blinking) manner. If bit C is a logical ONE, the character is to be blinked on and off on the display screen. Bit D controls the underlinking of the character. If bit D is a logical ZERO, the character displayed on the screen is not to be underlined. If bit D is a logical ONE, the character is to be displayed on the screen with an underline in scan line 12, dots 1' through 9' (see FIG. 2). Bit E is used to control the low intensity mode. If bit E is a logical ZERO, the character is to be displayed in normal brightness. If bit E is a logical ONE, the character is to be displayed in the low intensity (reduced brightness) mode. Bit F is used to control inverse video. If bit F is a logical ZERO, the character is to be displayed in the normal mode (i.e., a light character against a dark background). If bit F is a logical ONE, the character is to be displayed in the inverse video mode in which a dark character will be displayed against a light background. In the preferred embodiment, the video attribute bits (bits 8 and B through F) of the 16-bit refresh memory data word are set under control of the firmware of the display controller as the data character is entered from a keyboard and they may also be set in the data received from the computer.

Figure 7:
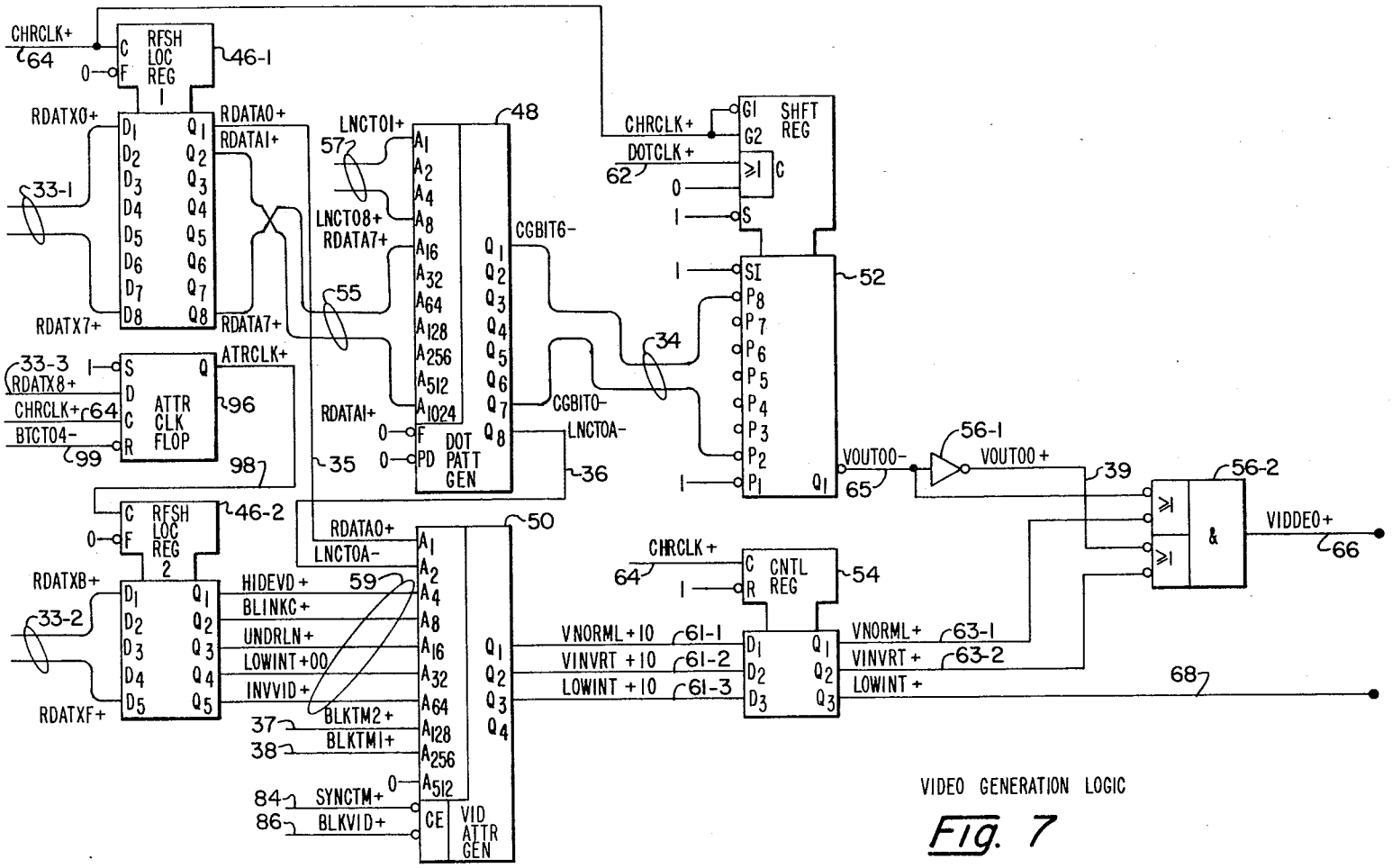
FIG. 7 is a detailed illustration of the video generation logic.

Returning now to the video generation logic shown in FIG. 7, the output of refresh memory 44 is stored in refresh local register 46 under the control of character clocking signal CHRCLK+. More specifically, the bits 0 through 7 of the refresh memory data word which contain the cursor and the 7-bit ASCII code corresponding to the data character are stored in refresh local register 1, element 46-1, and bits B through F are stored in refresh local register 2, element 46-2. Bits 0 through 7 are input to refresh local register 1, element 46-1, on lines 33-1 at inputs D1 through D8 as signals RDATX0+ through RDATX7+. Bits B through F are input into refresh local register 2, element 46-2, on lines 33-2 at inputs D1 through D5 as signals RDATXB+ through RDATXF+.

Character clocking signal CHRCLK+ on line 64 at the clock (C) input of refresh local register 1, element 46-1, is used to directly clock the cursor bit and the 7 data character bits from the 16-bit data word from the refresh memory in preparation of refreshing the next column on the display screen. Bits B through F from the 16-bit data word are clocked into refresh local register 2, element 46-2, by attribute clocking signal ATRCLK+ on line 98 at the clock (C) input only if bit 8 of the 16-bit refresh memory data word indicates that the character is the start of a video attribute field. If bit 8 of the 16-bit refresh memory data word is a logical ZERO indicating that the data character is part of a multiple character field, refresh local register 2 is not clocked and the previous video attribute bits remaining in refresh local register 2 from the character that started the video attribute field are used to control the display of the current character.

Attribute clocking signal ATRCLK+ on line 98 is generated by attribute clock flop 96 which is a D-type flip-flop. If the attribute field bit (bit 8) in the 16-bit refresh memory data word is a logical ONE, signal RDATX8+ on line 33-3 at the data (D) input of attribute clock flop 96 will be clocked into flip-flop 96 by character clocking signal CHRCLK+ at the clock (C) input and result in the setting of flip-flop 96. The setting of attribute clock flop 96 results in the Q output, signal ATRCLK+, becoming a logical ONE, which in turn results in the clocking of refresh local register 2, element 46-2. Attribute clock flop 96 is reset by signal BTCTO04− at the reset (R) input during each character time before the character clocking signal CHRCLK+ occurs, thus conditioning flip-flop 96 to be set and produce the attribute clocking signal if bit 8 of the refresh memory data word indicates that the character starts a video attribute field.

The timing of character clocking signal CHRCLK+ and attribute clocking signal ATRCLK+ is such that signal ATRCLK+ lags signal CHRCLK+ by the propagation delay due to the setting of flip-flop 96. In the preferred embodiment, this results in signal ATRCLK+ lagging signal CHRCLK+ by approximately 20 nanoseconds which is not significant when compared to the 450 nanosecond character scan time. Therefore, unless indicated otherwise, the clocking of refresh memory register 2 will be referred to as being done on the character time by signal CHRCLK+.

The output of refresh local register 1, signals RDATA1+ through RDATA7+ on lines 55, is used to address dot pattern generator PROM 48. The output of refresh local register 2, signals HIDEVD+, BLINKC+, UNDRLN+, LOWINT+OO, and INVVID+ on lines 59, along with signal RDATA0+ on line 35 from refresh local register 1 and signal LNCT0A+ on line 36 from dot pattern generation PROM 48 are then used to address video attribute generation PROM 50. One character time later the output of dot pattern generation PROM 48 is clocked into shift register 52 by character clocking signal CHRCLK+ on line 64 and the output of video attribute generation PROM 50 on lines 61-1 through 61-3 are clocked into control register 54 by character clocking signal CHRCLK+ on line 64. The 7-bit dot pattern used to control the generation of the dots 2' through 8' of scan lines 2 through 11 of the character cell (see FIG. 2) comes from dot pattern generation PROM 48, one scan line at a time.

Dot pattern generation PROM 48 contains 2,048 words of 8 bits per word. The 11-bit address used to retrieve the dot pattern from the dot pattern generation PROM 48 is comprised of the 7-bit ASCII code of the data character to be displayed in the character cell and the 4-bit scan line count which is a value of 0 through 12 for the 13 scan lines associated with each character cell of a row of characters. The 7-bit ASCII code for the data character appears as signals RDATA1+ through RDATA7+ on lines 55 and the 4-bit scan line count from line counter 47 (see FIG. 4) appears as signals LNCT01+ through LNCT08+ on lines 57. The 8-bit output of dot pattern generation PROM 48 is used as input to shift register 52 and as an address input to video attribute generation PROM 50. The 7 bits corresponding to character cell scan dots 2' through 8' which are signals CGBIT0− through CGBIT6− on lines 34 are parallel loaded into shift register 52 by character clocking signal CHRCLK+ on line 64. The eighth bit of the PROM word from dot pattern generation PROM 48 is used to indicate scan line 12 which is the underline scan line and is output as signal LNCT0A− on line 36. This encoding of the eighth bit of the dot pattern generation PROM data word to indicate the underline scan line (line 12) saves having to do a decode on the four signals LNCT01+ through LNCT08+ from line counter 47 to detect scan line 12. In the preferred embodiment, dot pattern generator PROM 48 is a type 2716 PROM manufactured by Intel Corporation of Santa Clara, Calif., 95051, and described in their publication entitled *Intel Corporation Data Catalog* copyrighted 1980 which is incorporated herein by reference.

The organization of the data in dot pattern generation PROM 48 can be better appreciated by referencing FIG. 9. FIG. 9 illustrates the contents of the 8-bit data words in the PROM corresponding to locations addressed 40F through 422 (hexadecimal addresses). Each 8-bit data word in the dot pattern generation PROM 48 is precoded with a 7-bit dot pattern which corresponds to one scan line (dots 2' through 8') and the 8th bit being used as a signal to whether this dot pattern data word in the PROM is associated with the twelfth scan line (underline line) of the character cell. The dot pattern is arranged in the dot pattern generation PROM 48 such that the 7 most significant bits of the address correspond to the ASCII code for the data character and the 4 least significant bits correspond to the scan line count of the data cell. Therefore, the data words in locations 410 through locations 41F contain the dot pattern associated with generating an upper case letter "A". It being noted that the ASCII code for the character "A" is 41 (hexadecimal). The data words of dot pattern generation PROM 48 are precoded such that a logical ZERO appears in bits 1 through 7 for each dot which is to be illuminated on the display screen when the character is displayed in normal mode. Therefore, PROM locations 410 through 41C in FIG. 9 correspond to the character cell illustrated in FIG. 2.

Bit 8 of the PROM data words contains a logical ZERO if the data word corresponds to the twelfth scan line of the character cell and therfore bit 8 of data word 41B is a logical ZERO. All other bits of the PROM data word not indicated to be a logical ZERO in FIG. 9 are precoded as a logical ONE. For illustration purposes, these logical ONEs are not illustrated in FIG. 9 to make the dot pattern of the data character more easily recognizable.

Because there are only 13 lines per character cell which are displayed on the screen and the line count which is binary encoded on signal lines LNCT01+ through LNCT08+ on lines 57 only go from the value of 0 through 12 (0 through C hexadecimal), the fourteenth, fifteenth and sixteenth data words in each group of 16 data words in the dot pattern generation PROM are never addressed and therefore are not retrieved and output on the outputs Q1 through Q8 of dot pattern generation PROM 48 (i.e., locations 41D, 41E, and 41F in FIG. 9 associated with the character "A" are not accessed and therefore their content is not used). Locations 400 through 40F contain the dot pattern for the character "@" (ASCII code 40, hexidecimal) and locations 420 through 42F contain the dot pattern for the upper case letter "B" (ASCII code 42, hexidecimal) a portion of which is shown in FIG. 9.

Dot pattern generation PROM 48 is always enabled by the logical ZERO appearing at the function (F) input and another logical ZERO signal being applied to the power down (PD) input such that the PROM is free running thereby providing at its Q outputs an 8-bit data word which corresponds to the 11-bit binary encoded address presented at its address (A) inputs. The timing in the video generation logic is such that the availability of the address to dot pattern generation PROM 48 occurs at the beginning of one character time and the dot pattern output of PROM 48 is not used until the beginning of the next character time. In the preferred embodiment, the time between character times is approximately 450 nanoseconds. Although the dot pattern output by dot pattern generator PROM 48 is not used until the next character time, the scan line 12 indicator signal LNCT0A− on line 36 is used as an address input to video attribute generation PROM 50 so it must be available to that video attribute generation PROM 50 can be access during the same character time period.

The video attribute generation PROM 50 combines the 9 signals which affect the video attribute of the character cell to be displayed on the CRT 11 and provides 3 video control output signals. The 9 video attribute controlling signals are used as address inputs into video attribute generation PROM 50 to retrieve a 4-bit word which appears at the Q outputs. In the preferred embodiment, video attribute PROM 50 is a type 82S137 PROM which contains 1,024 words of 4 bits each and is manufactured by Signetics Corporation of Sunnyvale, Calif., 94068, and is described in their publication entitled *Signetics Data Manual* copyrighted 1976 which is incorporated herein by reference. In the preferred embodiment, only 512 words of the 1,024 data words available in video attribute generation PROM 50 are used because only 9 bits of the 10 bits address are used with a logical ZERO being applied to address input A512. Further, in the preferred embodiment only 3 bits of each data word are used and the 4th bit which appears at the Q4 output is not used.

Figures 10, 11:
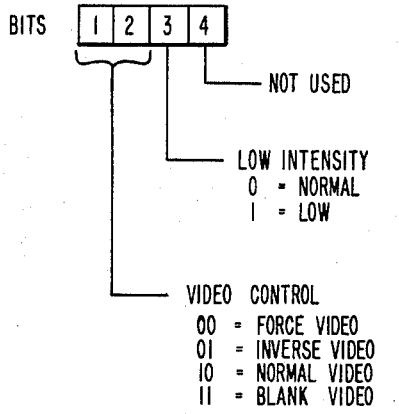
FIG. 10 is a diagram illustrating the data format of the data which is precoded in the video attribute generator of FIGS. 4 and 7.
FIG. 11 is an illustration showing four states on the display screen for a character cell containing the character A in a blinking data field and also containing the cursor.

The format of the data words of the video attribute generation PROM 50 is illustrated in FIG. 10 which shows that bit 3 is used to control the intensity of the dot displayed on the CRT screen and if a logical ZERO, the intensity of the dot is displayed in the normal brightness and if a logical ONE, it is displayed in the low intensity (reduced brightness). This low intensity signal appears as signal LOWINT+10 on line 61-3 at the Q3 output. Bits 1 and 2 appear as signal VNORML+10 and signal VINVRT+10 on lines 61-1 and 61-2 at the Q1 and Q2 outputs respectively. Bits 1 and 2 are used to control the video output and the 2 bits are binary encoded to provide for: the forcing of the video signal, the inverting of the video signal, the blanking of the video signal, or a normal video signal. As will be seen hereinafter, these two video control signals (VNORML+10 and VINVRT+10) are used to control the video signal VOUT00− output at the Q1 output of shift register 52 which is derived from the dot pattern generation PROM 48.

Video attribute generation PROM 50 is precoded such that for each unique 9-bit address which is determined by the 9 video attribute signals which are input into address bits A1 through A256, a unique 4-bit data word is output which reflects whether a dot is to be displayed on the screen in low intensity or in normal intensity; whether a dot is to be forced on the screen independent of what is called for by the dot pattern generator; whether the dot called for by the dot pattern generator is to be blanked (inhibited); whether the dot pattern called for by the dot pattern generator is to be inverted; or whether the dot called for by the dot pattern generator is to be displayed in the normal video mode. Without the use of video attribute generation PROM 50, a large amount of combinational logic would be required to allow all 9 video attribute signals to interact with the video signal VOUT00− output by shift register 52. In addition, the use of a PROM, instead of combinational logic, allows the hardware designer greater flexibility in determining the results of the interaction of the video attribute signals which would not otherwise be possible with hardwired combinational logic. To change the result of attribute interaction, the data of video attribute generation PROM 50 need only be recoded. Further, by generating 3 video control signals in video attribute generation PROM 50 the amount of combinational logic between development of the video signal in shift register 52 and the final video signal presented to transmit logic 71 is reduced so that the signal delays do not exceed the dot time period of 50 nanoseconds of the preferred embodiment.

The 9 video attributes which are used to address video attribute generation PROM 50 controls the output of PROM 50 in the following manner. The cursor attribute which is represented by signal RDATA0+ on line 35 from refresh local register 1, element 46-1, when a logical ONE indicates that the cursor is in the position that the present character cell and any data entered from a keyboard will be entered into this character cell position. Normally, the cursor is displayed on the display screen as a blinking underline of the data character within the character cell. That is, scan line 12 of the character cell where the cursor is located blinks on and off (dots 1' through 9'). Thus when bit 1 of the 16 bit data word from the refresh memory 44 indicates that the cursor is associated with the current character cell being displayed and signal LNCT0A− on line 36 from dot pattern generation PROM 48 indicates that this is scan line 12, the data word retrieved from video attribute generation PROM 50 will have bits 1 and 2 set to the logical ZERO state to force the video output signal VIDDEO+ on line 66 to be a logical ONE, thereby forcing a dot to appear on the display screen and generate the cursor underline. Because any character cell in which the cursor can appear could be underlined it is desirable to distinguish the case of a cursor appearing in a character cell without an underline and a cursor appearing in a character cell with an underline. Therefore, the video attribute generation PROM 50 has been precoded such that the data words in PROM 50 addressed by having address bit A1 a logical ONE and address bit A6 a logical ONE, will result in the blinking of the character cell as a whole and not just a blinking underline.

The line 12 indicator which is input into address input A2 of video attribute generation PROM 50 will be a logical ZERO when scan line 12 is being refreshed on the display screen. Thus, when signal LNCT0A− on line 36 from dot pattern generation PROM 48 is a logical ZERO, it indicates that the 12th scan line is being scanned and if the cursor is located in the current character cell, the video output should be forced to display a blinking underline or if the underline attribute is set for the current character which is indicated by signal UNDRLN+ from the Q3 output of refresh local register 2, element 46-2, being a logical ONE, the video output will also be forced. In the normal case, the scan line 12 and underline or cursor attributes are combined by precoding video attribute generation PROM 50 data words addressed by them to have bits 1 and 2 be logical ZEROs so that signals VNORML+ and VINVRT+ on lines 63-1 and 63-2 will force the video output by making the video signal VIDDEO+ on line 66 a logical ONE. If a character cell contains an underline and the character cell is to be displayed in the inverse video mode, then the video attribute generation PROM 50 is precoded such that the output will blank out line 12. This is done by making signal VNORML+10 and signal VINVRT+10 logical ONEs.

If signal HIDEVD+ at the A4 address input of video attribute generation PROM 50 is a logical ONE, it indicates that the character data within the character cell is not to be displayed. Therefore in the case of normal video, the video attribute generation PROM 50 data words are precoded such that signal VNORML+10 and signal VINVRT+10 will be logical ONEs, thereby blanking the video output from shift register 52. This blanking of the video will be done for all scan lines except scan line 12 which, if underlined, will be forced such that the underline will appear on the display screen. If the character cell whose data is to be hidden is being displayed in the inverse video mode, then instead of blanking video as is done in the normal case, the video output is forced by making signal VNORML+10 and signal VINVRT+10 logical ZEROs.

If signal BLINKC+ at the Q2 output of refresh local register 2, element 46-2, is a logical ONE at the A8 address input of video attribute generation PROM 50, then the data character and underline and the character cell are to be blinked. This character cell blinking is done in conjunction with signal BLKTM2+ on line 37 at the A128 address input of video attribute generation PROM 50. When signal BLKTM2+ is a logical ZERO, the data character and underline are not to be displayed and this is done by precoding the data words of video attribute generation PROM 50 such that the VNORML+10 and VINVRT+10 signals are logical ONEs, thereby blanking the video output on signal VIDDEO+ on line 66.

Within the display terminal of the preferred embodiment, there are 2 blink rates: one blink rate is controlled by signal BLKTM2+ on line 37 and the other blink rate is controlled by signal BLKTM1+ on line 38. Signal BLKTM2+ is used to control the blinking of data and changes from a logical ONE to a logical ZERO at a rate that is half the rate of signal BLKTM1+. Signal BLKTM1+ is used to control the blinking of the cursor on the display screen such that a cursor will blink at twice the rate of a blinking data cell. Both of these signals BLKTM1+ and BLKTM2+ in the preferred embodiment are controlled by firmware which sets them to a logical ONE and logical ZERO state at predetermined rates.

As described above, signal UNDRLN+ at the address A16 input of video attribute generation PROM 50 is used to control whether an underline appears within the character cell on scan line 12. Signal LOWINT+00 in a logical ONE state indicates that the character is to be displayed as a series of low intensity dots on the display screen. Usually this signal is not modified and video attribute generation PROM 50 is precoded such that in most cases, if the PROM data word selected by address input A32 is in a logical ONE state, it will result in retrieving a PROM data word with bit 3 being a logical ZERO such that signal LOWINT+10 on line 61-3 will be a logical ONE which in turn will result in the output of control register 53, signal LOWINT+ on line 68, being a logical ONE. This in turn will result in the dots on the display screen being displayed in the low intensity mode. However, there are several cases in which although the dot making up the data character within the character cell are displayed in The low intensity, it has been found desirable to display other dots within that cell in the normal intensity. For example, if the cursor is located in a character cell to be displayed in the low intensity mode, the cursor displayed as an underline on scan line 12 is displayed in the normal intensity mode and the rest of the scan lines of the character cell are displayed in the low intensity mode. By displaying the underline in normal intensity mode in low intensity cells, the cursor is more visable to the operator. Therefore, the data words in video attribute generation PROM 50 which are retrieved when signal RDATA0+ is a logical ONE (indicating that this cell contains the cursor) and signal LNCT0A− is a logical ZERO (indicating that this is the 12th scan line) and although signal LOWINT+00 is a logical ONE (indicating that the data is to be displayed in a low intensity) those data words are precoded such that bit 3 will be a logical ZERO, thereby making signal LOWINT+10 on line 61-3 a logical ZERO and forcing the underline to be displayed in the normal intensity.

Signal INVVID+ at the A64 address input of video attribute generation PROM 50 when in the logical ONE state indicates that the character cell is to be displayed in the inverse video mode. Therefore, video attribute generation PROM 50 is precoded such that it will normally result in signal VNORML+10 being a logical ZERO and signal VINVRT+10 being a logical ONE, thereby inverting the output of what would otherwise occur for signal VIDDEO+ on line 66.

Signals BLKTM2+ and signal BLKTM1+ at the A128 and A256 inputs of video attribute generation PROM 50 as indicated above are used to control blink rates and toggle between logical ONE and logical ZERO at two distinct rates so that the cursor will blink at one rate and the data will blink at a different rate. FIG. 11 illustrates the four possible cases of combining the blinking of the character data and the cursor. When signal BLKTM2+ is a logical ZERO, the character data is not to be displayed; when a logical ONE, the character data is to be displayed. When signal BLKTM1+ is a logical ZERO, the cursor is not to be displayed; when a logical ONE, the cursor is to be displayed. Therefore, if the cursor is currently located in a character cell where data is to be blinked, the character cell displayed on the display screen in the four different states as shown in FIG. 11. When signal BLKTM2+ and BLKTM1+ are both logical ZEROs, the data words of video attribute generation PROM 50 are precoded such that nothing is displayed on the display screen. When signal BLKTM2+ is a logical ZERO and signal BLKTM1+ is a logical ONE, the data words of video attribute generation PROM 50 are precoded such that only the underline in scan line 12 is displayed on the display screen. When signal BLKTM2+ is a logical ONE and signal BLKTM1+ is a logical ZERO, the data words of video attribute generation PROM 50 are precoded such that only the character data will appear on the display screen. When signal BLKTM2+ is a logical ONE and signal BLKTM1+ is a logical ONE, both the character data and the underline for the cursor will appear on the display screen. In the preferred embodiment, the blink rate for each of these four states is chosen to be one-fourth of a second such that signal BLKTM1+ changes logical states each one-fourth of a second and signal BLKTM2+ changes logical states every half second.

If the character on the display screen is being displayed in the inverse video mode, blink timing signal BLKTM2+ and BLKTM1+ interact with the inverse video signal INVVID+ such that when the information is to be blinked (hidden) instead of outputting a blanking video signal in bits 1 and 2 of the video attribute generation PROM 50 data words, a forcing video signal is produced by setting bits 1 and 2 to a logical ONE thereby making signal VNORML+10 and signal VINVRT+10 logical ONEs at the Q1 and Q2 outputs of video attribute generation PROM 50.

Unlike the dot pattern generation PROM 48 which is free running by having logical ONE signals at the enable output (F) and power down (PD) inputs thereby providing that the 8-bit data word will always appear at the Q1 through Q8 outputs in response to an 11-bit address appearing at the address inputs, the video attribute generation PROM 50 is enabled by signal SYNCTM+ on line 85 and signal BLKVID+ on line 86 at the chip-enabled inputs being both logical ZEROs. Signal SYNCTM+ is generated by refresh address generator 53 (see FIG. 4) such that it will be set to the logical ONE state (thereby disabling the output of video attribute generation PROM 50) when the electron beam of the raster scan is making a horizontal retrace or a vertical retrace. By setting signal SYNCTM+ to a logical ONE during retrace, and tying the Q1 signal VNORML+10 and the Q2 output signal VINVRT+10 to pull up resistors (not shown) thereby forcing them to the logical ONE state during retrace, the video output signal VIDDEO+ on line 66 will be a logical ZERO thereby assuring that the electron beam will not illuminate any of the phosphorous on the CRT 11 display screen. Signal BLKVID+ at the other chip-enabled (CE) input of video attribute generation PROM 50 is set to the logical ONE state and thereby disabling the output of PROM 50 and forcing the video to a blank, in response to other logical not shown when it is desired to blank the CRT display.

Shift register 52 is parallel loaded from the dot pattern generation PROM 48 at the beginning of a character time and is then shifted one bit at a time for the next 8 dot times to serially provide dots for dots 1′ through 9′ of the scan line of a character cell. In the preferred embodiment, shift register 52 is of the type SN74166 manufactured by Texas Instruments Incorporated of Dallas, Tex. Under the control of the G1 and G2 clocking inputs which are connected to character clock signal CHRCLK+, 8 bits are loaded in parallel at the P1 through P8 inputs. Inputs P2 through P8 are connected to the output of dot pattern generation PROM 48 such that they receive the dot pattern for a scan line for dots associated with dots 2′ through 8′ of a character cell (see FIG. 3). Input P1 is connected to a logical ONE to set the dot 1′ of the scan line to a logical ONE such that in a normal case there will be no dot generated for dot 1′ of a scan line. The serial input (SI) is also connected to a logical ONE such that as the 8 bits within the shift register are shifted, a logical ONE will be shifted into the vacated bit positions and thereby generate a logical ONE as output for dot 9′ of the character cell scan line. It being noted that the output signal VOUT00− will be appearing at the Q1 output as a logical ONE for each dot which is not to be illuminated on the screen and as a logical ONE for each dot which is to be illuminated on the screen because the dot pattern stored in dot pattern generation PROM 48 is stored with logical ZEROs for dot positions which are to be illuminated. After being parallel loaded at a character time, the shift register 52 is serially shifted so that a single bit appears at the Q1 output each time dot clocking signal DOTCLK+ on line 64 transitions to the logical ONE state at the serial clock (C) clocking input. The overriding clear input (S) of shift register 52 is set to a logical ONE because it is not used.

The output of video attribute generation PROM 50 is input and latched in control register 54 by character clocking signal CHRCLK+ on line 64 at the clock (C) input. The reset (R) input of control register 54 is set to a logical ONE thereby inhibiting the reset of the register. The 3 video control signals VNORML+10, VINVRT+10, and LOWINT+10 at the D1, D2, and D3 inputs respectively of control register 54 are clocked into the register at the beginning of a character time and therefore remain available at the Q1, Q2, and Q3 outputs respectively for the full period of the character generation. That is, signals VNORML+ on line 63-1, signal VINVRT+ on line 63-2, and signal LOWINT+ on line 68 remain constant for a full character time because the attributes that affect the generation of the dots within a character cell apply to all 9 dots (dot 1′ through 9′ of FIG. 2) of the character cell.

The low intensity signal LOWINT+ on line 68 goes directly to transition logic 71 (see FIG. 4) whereas signal VNORML+ and signal VINVRT+ are sent to AND- OR- INVERTER gate 56-2 which outputs video signal VIDDEO+ on line 66. Dot video signal VOUT00− on line 62 is inverted by inverter 56-1, the output of which is signal VOUT00+. Signals VOUT00+ and VOUT00− are also input to AND-OR- INVERTER gate 56-2 which in the preferred embodiment is a type SN74S51 integrated circuit manufactured by Texas Instruments Inc. of Dallas, Tex. As discussed hereinbefore, the video control signals VNORML+ and VINVRT+ (corresponding to signals VNORML+10 and VINVRT+10) are binary encoded to provide the four functions such that the video signal output by shift register 52 can be normal (signal VIDDEO+ will be a logical ONE if signal VOUT00+ is a logical ONE), inverted (signal VIDDEO+ will be a logical ZERO if signal VOUT00+ is a logical ONE), forced (signal VIDDEO+ will be a logical ONE, independent of the state of signal VOUT00+), or blanked (signal VIDDEO+ will be a logical ZERO, independent of the state of signal VOUT00+). As described hereinbefore, the two output signals VIDDEO+ on line 66 and the low intensity signal LOWINT+ on line 68 are then closed into video sync register 70 (see FIG. 6) each bit time to maintain synchronization as the signals are transmitted to display monitor 77 (see FIG. 4).

The timing of the video generation logic is such that the output of dot pattern generation PROM 48 is clocked into shift register 52 and the output of video attribute generator PROM 50 is clocked into control register 54 one character time after their generating inputs become available at the output of refresh local register 1, element 46-1, and refresh local register 2, element 46-2 (assuming that refresh local register 46-2 was clocked because bit 8 of the refresh memory data word contained a logical ONE indicating that the character was the start of a video attribute field). The data inputs of refresh local registers 1 and 2 are available at the 16-bit data word output from refresh memory 44 one character clock period after the refresh memory address was available at the output of refresh address generator 53 (see FIG. 4). For example, at the time the address of the 16-bit refresh memory data word corresponding to the character cell determined by the intersection of column 33 and row 2 (see FIG. 1) becomes available at the output of refresh address generator 53, the 16-bit data word corresponding to the character cell in column 32 of row 2 is available at the output of refresh memory 44 and is clocked into refresh local register 46 and the dot pattern generated by dot pattern generation PROM 48 and the video control signals generated by video attribute generation PROM 50 for column 31 of row 2 are respectively clocked into shift register 52 and control register 54. That is, while a character in column 31 is being displayed on the display screen of CRT 11, the dot pattern and video attributes associated with column 32 are being generated, the data word in refresh memory 44 for column 33 is being accessed.

As described above, in the preferred embodiment the display screen contains 25 rows of 80 columns each (see FIG. 1). In the preferred embodiment, the 25th row on the display screen is used as a status line in which a message from the computer can be displayed or to display conditions produced within the display controller. These conditions are displayed in English words and can include an indicator of READY, the modes of operation, error messages, and the current row and column position of the cursor.

In the preferred embodiment, the operator can elect to operate the display terminal in a roll mode (scrolling mode) in which, when the cursor is on row 24, receipt of a line feed character causes the contents of the screen to roll up (i.e., the 24th row becomes blank and the previous contents of row 24 are displayed on row 23, the data that was displayed on row 1 disappears from the screen, and the cursor remains on row 24. Rolling of the screen data can also occur when data is entered at the end of the 24th row (i.e., more than 80 displayable characters). The roll mode of operation allows successive rows of data to be received by the display terminal with only the last 24 rows of data being retained and displayed on the display screen of the CRT 11. If the terminal is operated in the non-roll mode (i.e., no scrolling), receipt of data past the 24th row or a line feed character that follows the 24th row does not cause the data to roll up and a data overflow message will be displayed on the status line (row 25).

In the preferred embodiment, this ability to roll the rows 1 through 24 and hold row 25 fixed is accomplished by logic in refresh address generator 53 (see FIG. 4). This rolling of the display screen rows is accomplished by use of a roll register to generate a relocated address in refresh memory 44 when refreshing rows 1 through 24 and to always access row 25 in a fixed location when refreshing row 25. This is implemented by providing a roll register that provides an offset for accessing the refresh memory locations associated with rows 1 through 24 and by not providing an offset while accessing the memory locations associated with row 25. As described above in the preferred embodiment, the column counter 45 divides the character rate by 104. The counts of 0 through 79 (corresponding to columns 1 through 80 of FIG. 1) are display columns and 80 and 103 (corresponding to columns 81 through 104 of FIG. 1) are used for the horizontal retrace. The row counter 49 (see FIG. 4) has columns of 0 through 24 (corresponding to rows 1 through 25 of FIG. 1) and uses counts 25 and 26 (corresponding to rows 26 and 27 of FIG. 1) for the vertical retrace.

In the preferred embodiment, refresh memory 44 is a random access memory containing 2,048 words of 16 bits each composed of 8 RAM semiconductor chips, each containing 1,024 words of 4 bits each. Refresh memory 44 is laid out as illustrated in FIG. 12. If the display is operating in the non-scroll mode, refresh memory locations addresses 0 through 79 contains the 16-bit data words which are used to refresh columns 1 through 80 of row 1. Similarly, again if operating in the non-scroll mode, locations 80 through 159 are used to refresh row 2, columns 1 through 80. This organization is continued such that locations 1920 through 1999 are used to refresh columns 1 through 80 of row 25. Locations 2000 through 2047 are not used.

One method of rolling the rows 1 through 24 on the display screen would be to move the contents of each word in the refresh memory by 80 locations (i.e., that is, move the contents of location 80 to location 0, move the contents of location 81 to location 1, etc.) until each word in the refresh memory was moved by 80 locations with the exception that the locations 1920 through 1999 would not be moved because the 25th row is dedicated to status information and does not scroll in the preferred embodiment. This method of accomplishing the scrolling of the data on the screen is not satisfactory because a large amount of time would be necessary to access each location and write it into a second location having an address which is 80 less than the location from which it is moved. Therefore, the refresh address generator 53 (see FIG. 4) has the logic shown in FIG. 13 which accomplishes the rolling of rows 1 through 24 without the physical movement of the data within refresh memory 44.

When data on the display screen is to be scrolled, roll register 90 is loaded under the control of clocking signal ROLRLD- on line 95 thereby loading the 5-bit roll count contained on lines 87 as signals LBDT03+ through LBDT07+. This 5-bit roll count loaded into roll register 90 is generated by logic in the display controller (not shown) and contains a value of from 0 through 23 which represents the number of rows that rows 1 through 24 on the display screen are to be rolled up. For example, when operating in the roll mode, when the logic of the display controller detects that a line feed has been entered when the cursor is located in row 24, the contents of the roll register are loaded with a value which is 1 greater than the previous value. In the preferred embodiment, this loading of the roll register 90 with the augmented roll value is done under firmware control.

The values from row counter 49 and roll register 90 are added together and a modulo 24 sum returned by rolled row generation PROM 91 when the value in row counter 49 is between 0 and 23. When the value in the row counter is 24, indicating that the status line (row 25) is being addressed, a result of 24 is output by rolled row generation PROM 91. For example, when the display controller is refreshing display row 22, the row counter 49 will have a row value (count) of 21 and if the information on the display screen has been scrolled up 5 rows, the roll register will have a roll value of 5. Rolled row generation PROM 91 outputs a data value equal to the results of adding the row value of 21 to the roll value of 5 (21+5=26) and taking the sum modulo 24 (26 modulo 24=2) so that a relocated row value of 2 would be in bits 1 through 5 of the data output as data from roll row generation PROM 91. This 5-bit relocated roll value of between 0 and 24 is then input into row address generation PROM 92 which multiplies the relocated roll value by 5 and adds to the product the 3 most significant binary bits of the column count from column counter 45 (see FIG. 4). The 7-bit result from row address generation PROM 92 is the 7 most significant bits of the 11-bit relocated refresh address used to access data in refresh memory 44. The 4 least significant bits of the refresh address used to access refresh memory 44 come directly from column counter 45 and complete the 11-bit address used in accessing one of 2,048 16-bit data words in refresh memory 44.

The essence of the refresh address generation logic is to add the row value to the roll vaue (except for the last row on the display, row 25) and multiply this result by 80 columns and add this to the column counter. This provides the character address for the display's refresh memory 44.

Figure 13:
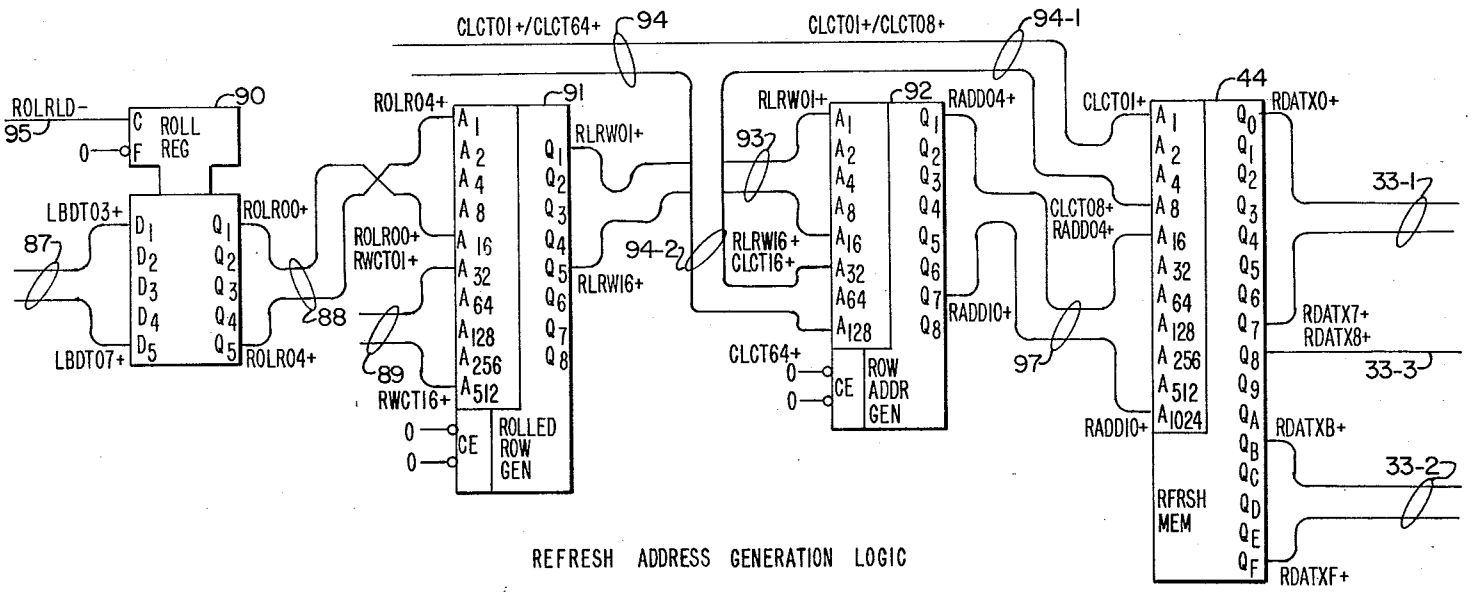
FIG. 13 is a detailed illustration of the refresh address generation logic of FIG. 4.
Figure 14:
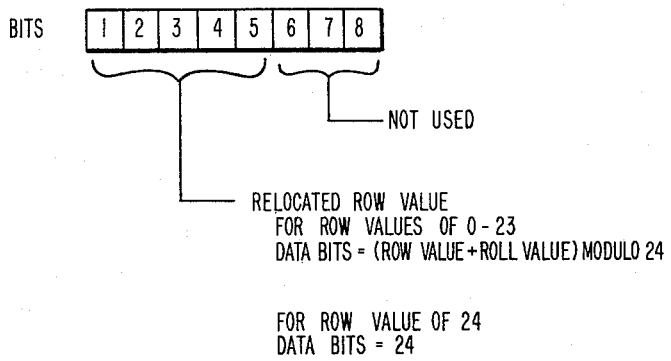
FIG. 14 is a diagram illustrating the data format of the data which is precoded in the rolled row generation PROM of FIG. 13.

The operation of the refresh address generator logic illustrated in FIG. 13 will now be described in more detail. The 5-bit roll value represented by signals LBDT03+ through LBDT07+ on lines 87 is clocked into roll register 90 inputs D1 through D5 by clocking signal ROLRLD- on line 95. After being clocked into roll register 90, the 5-bit roll value appears at outputs Q1 through Q5 as signals ROLR00+ through ROLR04+ on lines 88 and is passed to rolled row generation PROM 91 and used as address inputs A16 through A1. Signals RWCT01+ through RWCT16+ on lines 89 from row counter 49 provide the other 5 bits of the 10-bit address and are used as address inputs A32 through A512. Rolled row generation PROM 91 is precoded such that the data words retrieved by the 10-bit address presented contained a relocated roll value in bits 1 through 5, and bits 6 through 8 are not used (see FIG. 14).

Rolled row generation PROM 91 is precoded such that bits 1 through 5 of all data words addressed by row values of 0 through 23 from row counter 49 contained a value equal to the row value plus the roll value from roll register 90 with that sum being taken modulo 24. All data words addressed by an address representing a row value of 24 from row counter 49 contain bits 1 through 5 set to a value of 24 thus causing the status line (row 25) to be accessed from a fixed location in refresh memory 44. In the preferred embodiment, rolled row generation PROM 91 is implemented by using two 1,024 word by 4-bit PROMs of the type 82S137 manufactured by Signetics Corporation of Sunnyvale, Calif. 94068. The output of rolled row generation PROM 91 is always enabled by providing two logical ZERO signals to the chip-enabled (CE) inputs.

The relocated roll value is output at the Q1 through Q5 outputs of rolled row PROM 91 as signals RLRW01+ through RLRW16+ on lines 93 which are in turn input to row address generation PROM 92 address inputs A1 through A16. Address inputs A32 through A128 of row address generation PROM 92 are provided by signals CLCT16+ through CLCT64+ on lines 94-2 which contain the 3 most significant bits of the 7-bit column count provided by column counter 45. The 4 least significant bits from column counter 45, signals CLCT01+ through CLCT08+ on lines 94-1 are used as the 4 least significant bits of the 11-bit refresh memory address and go directly to refresh memory 44 as address inputs A1 through A8.

Figure 15:
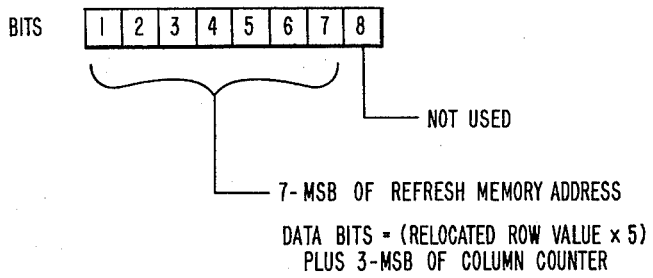
FIG. 15 is a diagram illustrating the data format of the data which is precoded in the row address generation PROM of FIG. 13.

Row address generation PROM 92 is precoded such that bits 1 through 7 contain data bits which are used as the 7 most significant bits of the refresh memory address. The value in bits 1 through 7 of row address PROM 92 data words is set to the relocated row value multiplied by 5 plus adding the value of the 3 most significant bits from column counter 45. The format of the row address generation PROM 92 data is illustrated in FIG. 15. For example, if the relocated row value is 2 and the column counter value is 79 (1001111 binary) corresponding to refreshing display column 80 of display row 22 scrolled 5 rows, row address generation PROM 92 outputs a data word containing a value of $(2\times5)+4=14$ (1110 binary) encoded in bits 1 through 7. This value when used with the 4 least significant bits of a column value of 79 (1111 binary) from column counter 45 will result in a refresh memory address of 239 (11101111 binary) for the example. This is the last 16-bit data word in refresh memory 44 associated with the relocated display row 22 (see FIG. 12). The output of row address generation PROM 92, which is used as the 7 most significant bits to address the refresh memory 44, is output at outputs Q1 through Q7 as signals RADD04+ through RADD10+ on lines 97. In the preferred embodiment, row address generation PROM 92 consists of two 256 word by 4-bit PROMs of the type IM5603A manufactured by Intersil Inc. of Cupertino, Calif. 95014, and described in their publication entitled *Intersil Product Guide* 1979 which is incorporated herein by reference.

As is the case for the rolled row generation PROM 91, row address generation PROM 92 is also used in a free running mode by applying logical ZEROs to the chip-enabled (CE) inputs. The timing of refresh address generator logic 53 is such that the roll value must be clocked into roll register 90 by signal ROLRLD− is sufficient time so that the 7 most signifcant bits of the refresh memory address will be available on lines 97 prior to the start of refreshing of a row. This is accomplished by clocking the roll value into roll register 90 during the horizontal retrace time following the completion of scan line 13 of the previous row.

As can be appreciated, the refresh address generator logic in the preferred embodiment allows row 25 to be fixed and rows 1 through 24 to be rolled (scrolled). The fixing of row 25 allows the status information contained therein to be easily updated by the display controller without having to compensate for it being relocated elsewhere within the refresh memory 44. This method of rolling the refresh data does not require the blocking of the refreshing of the display screen during a period of time in which large amounts of data are moved within the refresh memory. In the preferred embodiment, to scroll up one row of display data, only 80 words in the refresh memory must be manipulated (blanked in the vacated row) with the rolling of the other rows being handled by the roll register and associated logic.

Although the present invention has been described in terms of a display controller having 24 rows of data which can be rolled (scrolled) and one row of data which remains stationary, it is envisioned that many of the principles of the present invention could be employed with respect to a different number of rolled rows and a different number of stationary rows and with multiple groups of stationary rows. Additionally, it will occur to those skilled in the art that different registers, PROMs and other circuits can be substituted without departing from the present invention.

While the present invention has been particularly described and shown with reference to the preferred embodiment, it will be understood by those skilled in the art that the foregoing and other changes in form, dimension and detail may be made herein without departing from the spirit and scope of the invention.

Having described the invention, what is claimed as new and novel for which it is desired to secure Letters Patent is:

1. A refresh memory address generation apparatus in a display controller for accommodating the scrolling of rows of display information stored in fixed length rows within a refresh memory of said display controller, wherein said display controller includes faster scan logic having a column counter for holding a column value and row counter for holding a row value, said column value and said row value corresponding to the column and row of video information being refreshed on a display screen coupled to said display controller, said fixed length rows within said refresh memory containing a unit of video data for each column of video information displayable on said display screen, said refresh memory address generation apparatus comprising:

a. a roll register for holding a roll value indicative of the number of rows said video information is to be scrolled on said display screen;

b. first means, coupled to said roll register and said row counter, for adding said roll value to said row value to produce a relocated row value;

c. second means, coupled to said first means and said column counter, for multiplying said relocated row value by the number of video data units in each of said fixed length rows and adding to said product the column value to produce a relocated cell address in said refresh memory indicative of the address a unit of video data within said refresh memory corresponding to a cell of video information to be refreshed as determined by the intersection of said row value and said column value on said display screen, thereby accommodating the scrolling of rows of video information on said display screen without reconstructing said video information stored in said refresh memory;

wherein said first means is a first precoded memory, said first precoded memory addressed by using signals from said roll register indicative of said roll value and also addressed by using signals from said row counter indicative of said row value to retrieve first data words, and wherein each of said first data words is coded to contain the sum of said roll value plus the row value taken modulo the number of scrollable information rows displayable on said display screen thereby producing said relocated row value; and wherein said second means is a second precoded memory, said second precoded memory addressed by using signals from said first data words retrieved from said first precoded memory and also addressed by signals from said column counter indicative of said column value to retrieve second data words, and wherein each of said second data words is coded to contain the product of said relocated row value times the number of said units of video data contained in each of said fixed length rows within said refresh memory thereby producing said relocated cell address.

2. The apparatus as in claim 1 wherein said first precoded memory is a first PROM memory and wherein said second precoded memory is a second PROM memory.

3. The apparatus as in claim 1 wherein there are N rows of display information stored in said refresh memory and displayable on said display screen and wherein X rows of said N rows are scrollable rows and wherein N−X rows are fixed rows, such that said X scrollable rows can be moved up or down on said display screen and said N−X fixed rows remain in a fixed position on said display screen, said apparatus further comprising third means, included in said first means and responsive to said row value, for inhibiting said first means from adding said roll value to said row value if said row value corresponds to one of said N−X fixed rows and return instead for said relocated row value a value equal to said row value, thereby accommodating the scrolling of said X rows and the non-scrolling of said N−X rows.

4. A method of scrolling rows of video information stored in fixed length rows of video data units within a refresh memory of a display controller, wherein said display controller includes faster scan logic having a column counter for holding a column value and a row counter for holding a row value, said column value and row value corresponding to the column and row of video information being refreshed on a display screen coupled to said display controller, said fixed length rows containing a unit of video data for each column of video information within a row displayable on said display screen, said scrolling of said video information on said display screen being accomplished without reconstructing said video information stored in said refresh memory, which comprises:

a. accessing a roll value indicative of the number of rows that said video information is to be scrolled on said display screen;

b. adding said roll value to said row value to produce a relocated row value;

c. multiplying said relocated row value by the number of said units of said video data contained in each of said said fixed length rows within said refresh memory and adding to the product of said multiplication the column value from said column counter to form a relocated cell address used to access said units of video data in said refresh memory; and wherein the step of multiplying said relocated row value by the number of said units of video data contained in each of said fixed length rows within said refresh memory and add the column value is performed by using said relocated row value and said column value as address components used to access a second precoded memory containing second data words, wherein each of said second data words contains a product value corresponding to the product of the relocated roll value times the number of said units of video data per fixed length row plus the column value.

5. The method of claim 4 wherein the step of adding said roll value to said row value is performed by using said roll value and said row value as address components to access a first precoded memory containing first data words, wherein each of said first data words contains a modulo value corresponding to the sum of the roll value and the row value taken modulo the number of scrollable rows.

6. A video display system comprising:

a. a display device on which characters are displayed on a matrix of rows and columns;

b. a memory having a plurality of storage locations which store said characters to be displayed;

c. a row counter for holding a video roll count;

d. a column counter for holding a video column count;

e. a roll register for holding a roll count which defines the number of rows by which said characters are to be scrolled on said display device;

f. an adding means, coupled to said roll register and said row counter, said adding means for modularly adding said roll count to said video row count to produce a relocated video row count;

g. addressing means, coupled to said row counter, said adding means and said column counter, said addressing means for generating a memory address of each character to be displayed on said display device, wherein said addressing means, in response to a certain predetermined video row count or counts, utilizes said row count along with said column count to produce said memory address and, in response to all other video row counts, utilizes said relocated video row count along with said column count to produce said memory address, whereby a predetermined section of said memory has its contents displayed on a predetermined row or rows of said display device while the remainder of said memory has its contents scrollable on said display device.

7. A system as in claim 6 wherein said addressing means comprises a first precoded memory which is addressed by said video row count and said roll count, said video row counts dividing said first precoded memory into a corresponding plurality of first blocks, blocks of said plurality of first blocks corresponding to said predetermined video row count or counts being filled with the respective video row counts and the remaining blocks of said plurality of first blocks being filled with modular addition tables for said roll count and respective video row counts.

8. A system as in claim 7 wherein the number of columns is the product of an odd number times a power of 2 and wherein said addressing means comprises a multiplying means which multiplies the output of said adding means by said odd number and adds the product thereof to the odd number portion of said video column count.

9. A system as in claim 8 wherein said multiplying means comprises a second precoded memory addressed by said addressing means and said odd number portion of said video column count, said addressing means outputs dividing said second precoded memory into a corresponding plurality of second blocks, each block of said plurality of second blocks containing an addition table for said video column count based on the product of the respective addressing means output and said odd number.

* * * * *